US009305557B2

(12) United States Patent
Nagel et al.

(10) Patent No.: US 9,305,557 B2
(45) Date of Patent: Apr. 5, 2016

(54) APPARATUS AND METHOD FOR PROCESSING AN AUDIO SIGNAL USING PATCH BORDER ALIGNMENT

(75) Inventors: Frederik Nagel, Nuremberg (DE); Sascha Disch, Fuerth (DE); Stephan Wilde, Wendelstein (DE); Lars Villemoes, Jaerfaella (SE); Per Ekstrand, Saltsjobaden (SE)

(73) Assignees: Fraunhofer-Gesellschaft zur Foerderung der angewandten Forschung e.V., Munich (DE); Dolby International AB, Amsterdam Zuid-Oost (NL)

( * ) Notice: Subject to any disclaimer, the term of this patent is extended or adjusted under 35 U.S.C. 154(b) by 752 days.

(21) Appl. No.: 13/604,336

(22) Filed: Sep. 5, 2012

(65) Prior Publication Data

US 2013/0051571 A1 Feb. 28, 2013

Related U.S. Application Data

(63) Continuation of application No. PCT/EP2011/053313, filed on Mar. 4, 2011.

(60) Provisional application No. 61/312,127, filed on Mar. 9, 2010.

(51) Int. Cl.
*G10L 19/08* (2013.01)
*G10L 19/008* (2013.01)
(Continued)

(52) U.S. Cl.
CPC ..... *G10L 19/008* (2013.01); *G10L 19/0204* (2013.01); *G10L 21/038* (2013.01); *G10L 21/04* (2013.01)

(58) Field of Classification Search
CPC ..... G10L 19/008; G10L 21/038; G10L 25/18
USPC ..... 704/200–201, 500–501
See application file for complete search history.

(56) References Cited

U.S. PATENT DOCUMENTS 5,455,888 A 10/1995 Iyengar et al.
6,549,884 B1 * 4/2003 Laroche et al. ..... 704/207
(Continued)

FOREIGN PATENT DOCUMENTS

CN 1511312 A 7/2004
CN 101471072 A 7/2009
(Continued)

OTHER PUBLICATIONS

"ISO/IEC 14496-3", Information technology—Coding of audio visual objects—Part 3: Audio, 2009, 1416 Pages.
(Continued)

*Primary Examiner* — Douglas Godbold
(74) *Attorney, Agent, or Firm* — Michael A. Glenn; Perkins Coie LLP

(57) ABSTRACT

Apparatus for processing an audio signal to generate a bandwidth extended signal having a high frequency part and a low frequency part using parametric data for the high frequency part, the parametric data relating to frequency bands of the high frequency part includes a patch border calculator for calculating a patch border such that the patch border coincides with a frequency band border of the frequency bands. The apparatus further includes a patcher for generating a patched signal using the audio signal and the patch border.

13 Claims, 28 Drawing Sheets

(51) Int. Cl.

| | |
|---|---|
| ***G10L 19/02*** | (2013.01) |
| ***G10L 21/038*** | (2013.01) |
| ***G10L 21/04*** | (2013.01) |

(56) References Cited

U.S. PATENT DOCUMENTS

| | | | | |
|---|---|---|---|---|
| 6,766,300 | B1 | 7/2004 | Laroche | |
| 6,895,375 | B2 | 5/2005 | Malah et al. | |
| 7,337,108 | B2 | 2/2008 | Florencio et al. | |
| 7,917,360 | B2 | 3/2011 | Rogers | |
| 8,296,159 | B2 | 10/2012 | Neuendorf | |
| 2003/0187663 | A1 | 10/2003 | Truman et al. | |
| 2004/0125878 | A1* | 7/2004 | Liljeryd et al. | 375/242 |
| 2004/0176961 | A1* | 9/2004 | Manu et al. | 704/500 |
| 2006/0239473 | A1 | 10/2006 | Kjorling et al. | |
| 2007/0071116 | A1 | 3/2007 | Oshikiri et al. | |
| 2007/0078650 | A1 | 4/2007 | Rogers et al. | |
| 2007/0285815 | A1* | 12/2007 | Herre et al. | 360/13 |
| 2008/0222228 | A1 | 9/2008 | Halle | |
| 2009/0063140 | A1 | 3/2009 | Villemoes et al. | |
| 2009/0234646 | A1 | 9/2009 | Kjorling et al. | |
| 2009/0276069 | A1 | 11/2009 | Rogers | |
| 2010/0003543 | A1 | 1/2010 | Zhou | |
| 2010/0085102 | A1* | 4/2010 | Lee et al. | 327/334 |
| 2010/0114583 | A1* | 5/2010 | Lee et al. | 704/500 |
| 2011/0004479 | A1* | 1/2011 | Ekstrand et al. | 704/500 |
| 2011/0208517 | A1 | 8/2011 | Zopf | |
| 2012/0195442 | A1* | 8/2012 | Villemoes et al. | 381/98 |

FOREIGN PATENT DOCUMENTS

| | | | |
|---|---|---|---|
| EP | 1940023 | | 7/2008 |
| EP | 2214165 | | 4/2010 |
| JP | S55-107313 | | 8/1980 |
| JP | 2001-521648 | | 11/2001 |
| JP | 2004-053895 | | 2/2004 |
| JP | 2004-053940 | | 2/2004 |
| JP | 2004-206129 | | 7/2004 |
| JP | 2005-128387 | | 5/2005 |
| JP | 2005-521907 | | 7/2005 |
| JP | 2007-017628 | | 1/2007 |
| JP | 2007-101871 | | 4/2007 |
| JP | 2009-519491 | A | 5/2009 |
| TW | 200939211 | | 9/2009 |
| TW | 201007701 | | 2/2010 |
| WO | WO-9857436 | | 12/1998 |
| WO | 2002/084645 | A2 | 10/2002 |
| WO | WO2005/040749 | | 5/2005 |
| WO | WO-2009078681 | | 6/2009 |
| WO | 2009/095169 | A1 | 8/2009 |
| WO | WO-2009112141 | | 9/2009 |
| WO | WO-2010003557 | | 1/2010 |
| WO | WO-2010069885 | | 6/2010 |
| WO | WO-2010086461 | | 8/2010 |

OTHER PUBLICATIONS

"ISO/IEC 14496-3, 4.6.18.4.2", Synthesis Filterbank, 2005, 220-221.

"ISO/IEC 14496-3: 2005 ( E ) section 4.6.8", Joint Coding, 2005, 150-157.

Aarts, R et al., "A Unified Approach to Low- and High Frequency Bandwidth Extension", in AES 115th Convention. New York, New York, USA., Oct. 2003, 1-16.

Arora, M et al., "High Quality Blind Bandwidth Extension of Audio for Portable Player Applications", Presented at the 120th AES Convention. Paris, France, May 20, 2006, 1-6.

Dietz, M et al., "Spectral Band Replication, a Novel Approach in Audio Coding", Presented at the 112th AES Convention. Munich, Germany., May 10, 2002, 1-8.

Disch, S et al., "An Amplitude-and Frequency-Modulation Vocoder for Audio Signal", Proceedings of the 11th International Conference on Digital Audio Effects (DAFx-08). Espoo, Finland., Sep. 1, 2008, 1-7.

Duxbury, C et al., "Separation of Transient Information in Musical Audio Using Multiresolution Analysis Techniques", Proceedings of the COST G-6 Conference on Digital Audio Effects (DAFX-01). Limerick, Ireland., Dec. 6, 2001, 1-4.

Fielder, L et al., "Introduction to Dolby Digital Plus, an Enhancement to the Dolby Digital Coding System", Presented at the 117the Convention. San Francisco, CA, USA., Oct. 28, 2004, 1-29.

Flanagan, J et al., "Phase Vocoder", The Bell System Technical Journal, Nov. 1966, 1493-1509.

Henn, F et al., "Spectral Band Replications (SBR) Technology and its Application in Broadcasting", 112th AES Convention. Munich, Germany., 423-430, 2003.

Herre, J et al., "MP3 Surround: Efficient and Compatible Coding of Multi-Channel Audio", Presented at the 116th Conv. Aud. Eng. Soc. Berlin, Germany., May 8, 2004, 14 Pages.

Hsu, H et al., "Audio Patch Method in MPEG-4 HE-AAC Decoder", Presented at the 117th AES Convention. San Francisco, CA, USA., Oct. 28, 2004, 1-11.

Huan, Zhou et al., "Core Experiment on the eSBR module of USAC", 90. MPEG Meeting; Oct. 26-30, 2009; Xian; (Motion Picture Expert Group of ISO/IECT JTC1/SC29/WG11); Oct. 23, 2009.

Iyengar, V et al., "International Standard ISO/IEC 14496-3:2001/FPDAM 1: Bandwidth Extension", Speech Bandwidth Extension Method and Apparatus, Oct. 2002, 405 pages.

Laroche, J et al., "Improved Phase Vocoder Timescale Modification of Audio", IEEE Trans. Speech and Audio Processing. vol. 7, No. 3., May 1999, 323-332.

Laroche, J et al., "New Phase-Vocoder Techniques for Pitch-Shifting, Harmonizing and Other Exotic Effects", Proc. IEEE Workshop on App. of Signal Proc. to Signal Proc. to Audio and Acous. New Paltz, New York, USA., Oct. 17, 1999, 91-94.

Laersen, E et al., "Audio Brandwidth Extension—Application to Psychoacoustics, Signal Processing and Loudspeaker Design", John Wiley & Sons, Ltd., 2004, 33 Pages.

Larsen, E et al., "Efficient High-Frequency Bandwidth Extension of Music and Speech", In AES 112th Convention. Munich, Germany., May 2002, 1-5.

Makhoul, J et al., "Spectral Analysis of Speech by Linear Prediction", IEEE Transactions on Audio and Electroacoustics. vol. AU-21, No. 3., Jun. 1973, 140-148.

Meltzer, S et al., "SBR enhanced audio codecs for digital broadcasting such as "Digital Radio Mondiale" (DRM)", AES 112th Convention. Munich, Germany, May 2002, 4 pages.

Nagel, F et al., "A Harmonic Bandwidth Extension Method for Audio Codecs", ICASSP International Conference on Acoustics, Speech and Signal Processing. IEEE CNF. Taipei, Taiwan, Apr. 2009, 145-148.

Nagel, F et al., "A Phase Vocoder Driven Bandwidth", 126th AES Convention. Munich, Germany., May 2009, 1-8.

Neuendorf, M et al., "A Novel Scheme for Low Bitrate Unified Speech and Audio Coding", Presented at the 126th AES Convention. München, Germany., May 7, 2009, 1-13.

Neuendorf, M et al., "Unified Speech and Audio Coding Scheme for High Quality at Lowbitrates", ICASSP, 2009, 1-4.

Puckette, M et al., "Phase-locked Vocoder", IEEE ASSP Conference on Applications of Signal Processing to Audio and Acoustics. Mohonk, New York, USA., 1995, 4 Pages.

Ravelli, E et al., "Fast Implementation for Non-Linear Time-Scaling of Stereo Signals", Proc. of the 8th Int. Conference on Digital Audio Effects (DAFx'05). Madrid, Spain., Sep. 20, 2005, 1-4.

Robel, A et al., "A New Approach to Transient Processing in the Phase Vocoder", Proc. of the 6th Int. Conference on Digital Audio Effects (DAFX-03). London, UK., Sep. 8, 2003, 1-6.

Robel, A et al., "Transient Detection and Preservation in the Phase Vocoder", ICMC '03. Singapore. Link provided: citeseer.ist.psu.edu/679246.html, 2003, 247-250.

Zhong, Haishan et al., "Finalization of CE on QMF based harmonic transposer", 94. MPEG Meeting; Oct. 11-15, 2010; Guangzhou; (Motion Picture Expert Group or ISO/IEC JTC1/SC29/WG11); Oct. 28, 2010.

Zhou, Huan et al., "Finalization of CE on QMF based harmonic transposer", 93. MPEG Meeting; Jul. 26-30, 2010; Geneva; (Motion Picture Expert Group of ISO/IEC JTC1/SC29/WG11), Jul. 22, 2010.

(56) References Cited

OTHER PUBLICATIONS

Ziegler, T et al., "Enhancing mp3 with SBR: Features and Capabilities of the new mp3PRO Algorithm", Presented in the 112th AES Convention. Munich, Germany., May 10, 2002, 1-7.
"ISO/IEC JTC 1 Directives, 5th Edition, Version 3.0", Apr. 5, 2007; XP055182104 [retrieved on Apr. 10, 2015], 188 pages.
Audio Subgroup: "MPEG Audio CE methodology"; International Organization for Standardization, ISO/IEC JTC 1/SC 29/WG 11; Apr. 25, 2009, XP055182357 [retrieved on Apr. 13, 2015]; pp. 1-9.
HoDs: "MPEG 101"; International Organization for Standardization, ISO/IEC JTC 1/SC 29/WG 11; Jan. 31, 2005, XP055182379, [retrieved on Apr. 13, 2015]; 39 pages.
Webmaster: "Geneva Meeting—Document Register, 93; MPEG meeting; Jul. 26-30, 2010; Geneva; (Motion Picture Expert Group or ISO/IEC JTC1/SC29/WG11)", Jul. 29, 2010, XP055182371, [retrieved on Apr. 13, 2015]; 23 pages.
Webmaster: "Guangzhou Meeting—Document Register, 94. MPEG meeting; Oct. 11-15, 2010; Guangzhou; (Motion Picture Expert Group or ISO/IEC JTC1/SC29/WG11)", Jan. 15, 2011, XP055182374, [retrieved on Apr. 13, 2015]; 42 pages.
Kayhko, "A Robust Wideband Enhancement for Narrowband Speech Signal", Research Report, Helsinki Univ. of Technology, Laboratory of Acoustics and Audio Signal Processing, 2001, cited in Kallio, Laura, "Artificial Bandwidth Expansion of Narrowband Speech in Mobile Communications Systems", Master's Thesis, Helsinki Univ. of Technology, p. 65, Dec. 9, 2002.

* cited by examiner

| transpos. factor | target borders | target source | adjusted borders | adj. source |
|---|---|---|---|---|
| 2 | 4-8 | 2-4 | 4-7,7 | 2-3,85 |
| 3 | 8-12 | 2,66-4 | 7,7-11,9 | 2,56-3,96 |
| 4 | 12-16 | 3-4 | 11,9-15,8 | 2,975-3,95 |

low requency portion has freq. band width of 0-4kHz exemplary values in kHz

```
sfbL=0, sfbH=0
for patch = 1 to 4
    while sfbL <=N_Low && f_TableLow(sfbl) <= patch*f_TableLow(0)        } 254
    end
    if sfbL <=N_Low
        if patch *f_TableLow(0)-f_TableLow(sfbL-1) <=3                   <- 2525
            xOverBin(patch-1)=NINT(fftSizeSyn*f_TableLow(sfbL-1)/128)
        else
            while sfbH <=N_High&&f_TableHigh(sfbH)=patch*f_TableHigh(0)
                sfbH=sfbH+1
            end
            if patch*f_TableHigh(0)-f_TableHigh(sfbH-1)<=3               <- 2527
                xOverBin(patch-1)=NINT(fftSizeSyn*f_TableHigh(sfbH-1)/128)
            else
                xOverBin(patch-1)=NINT(fftSizeSyn*patch*f_TableHigh(0)/128)  <- 2529
            end
        end
    else
        xOverBin(patch-1)=NINT(fftSizeSyn*f_TableHigh(N_Low)/128)
        numPatches=patch-1
        break
    end
end
```

FIG 24A

| FIG 27 | |
|---|---|
| FIG 27A | FIG 27B |

| FIG 27 | |
|---|---|
| FIG 27A | FIG 27B |

APPARATUS AND METHOD FOR PROCESSING AN AUDIO SIGNAL USING PATCH BORDER ALIGNMENT

CROSS-REFERENCE TO RELATED APPLICATIONS

This application is a continuation of copending International Application No. PCT/EP2011/053313, filed Mar. 4, 2011, which is incorporated herein by reference in its entirety, and additionally claims priority from U.S. Application No. 61/312,127, filed Mar. 9, 2010, which is also incorporated herein by reference in its entirety.

The present invention relates to audio source coding systems which make use of a harmonic transposition method for high frequency reconstruction (HFR), and to digital effect processors, e.g. so-called exciters, where generation of harmonic distortion adds brightness to the processed signal, and to time stretchers, where the duration of a signal is extended while maintaining the spectral content of the original.

BACKGROUND OF THE INVENTION

In PCT WO 98/57436 the concept of transposition was established as a method to recreate a high frequency band from a lower frequency band of an audio signal. A substantial saving in bitrate can be obtained by using this concept in audio coding. In an HFR based audio coding system, a low bandwidth signal is processed by a core waveform coder and the higher frequencies are regenerated using transposition and additional side information of very low bitrate describing the target spectral shape at the decoder side. For low bitrates, where the bandwidth of the core coded signal is narrow, it becomes increasingly important to recreate a high band with perceptually pleasant characteristics. The harmonic transposition defined in PCT WO 98/57436 performs very well for complex musical material in a situation with low crossover frequency. The principle of a harmonic transposition is that a sinusoid with frequency $\omega$ is mapped to a sinusoid with frequency $T\omega$ where $T>1$ is an integer defining the order of transposition. In contrast to this, a single sideband modulation (SSB) based HFR method maps a sinusoid with frequency $\omega$ to a sinusoid with frequency $\omega+\Delta\omega$ where $\Delta\omega$ is a fixed frequency shift. Given a core signal with low bandwidth, a dissonant ringing artifact can result from SSB transposition.

In order to reach the best possible audio quality, state of the art high quality harmonic HFR methods employ complex modulated filter banks, e.g. a Short Time Fourier Transform (STFT), with high frequency resolution and a high degree of oversampling to reach the audio quality that may be used. The fine resolution may be used to avoid unwanted intermodulation distortion arising from nonlinear processing of sums of sinusoids. With sufficiently high frequency resolution, i.e. narrow subbands, the high quality methods aim at having a maximum of one sinusoid in each subband. A high degree of oversampling in time may be used to avoid alias type of distortion, and a certain degree of oversampling in frequency may be used to avoid pre-echoes for transient signals. The obvious drawback is that the computational complexity can become high.

Subband block based harmonic transposition is another HFR method used to suppress intermodulation products, in which case a filter bank with coarser frequency resolution and a lower degree of oversampling is employed, e.g. a multichannel QMF bank. In this method, a time block of complex subband samples is processed by a common phase modifier while the superposition of several modified samples forms an output subband sample. This has the net effect of suppressing intermodulation products which would otherwise occur when the input subband signal consists of several sinusoids. Transposition based on block based subband processing has much lower computational complexity than the high quality transposers and reaches almost the same quality for many signals. However, the complexity is still much higher than for the trivial SSB based HFR methods, since a plurality of analysis filter banks, each processing signals of different transposition orders T, may be used in a typical HFR application in order to synthesize the bandwidth that may be used. Additionally, a common approach is to adapt the sampling rate of the input signals to fit analysis filter banks of a constant size, albeit the filter banks process signals of different transposition orders. Also common is to apply bandpass filters to the input signals in order to obtain output signals, processed from different transposition orders, with non-overlapping spectral densities.

Storage or transmission of audio signals is often subject to strict bitrate constraints. In the past, coders were forced to drastically reduce the transmitted audio bandwidth when only a very low bitrate was available. Modern audio codecs are nowadays able to code wideband signals by using bandwidth extension (BWE) methods [1-12]. These algorithms rely on a parametric representation of the high-frequency content (HF) which is generated from the low-frequency part (LF) of the decoded signal by means of transposition into the HF spectral region ("patching") and application of a parameter driven post processing. The LF part is coded with any audio or speech coder. For example, the bandwidth extension methods described in [1-4] rely on single sideband modulation (SSB), often also termed the "copy-up" method, for generating the multiple HF patches.

Lately, a new algorithm, which employs a bank of phase vocoders [15-17] for the generation of the different patches, has been presented [13] (see FIG. 20). This method has been developed to avoid the auditory roughness which is often observed in signals subjected to SSB bandwidth extension. Albeit being beneficial for many tonal signals, this method called "harmonic bandwidth extension" (HBE) is prone to quality degradations of transients contained in the audio signal [14], since vertical coherence over sub-bands is not guaranteed to be preserved in the standard phase vocoder algorithm and, moreover, the re-calculation of the phases has to be performed on time blocks of a transform or, alternatively of a filter bank. Therefore, a need arises for a special treatment for signal parts containing transients.

However, since the BWE algorithm is performed on the decoder side of a codec chain, computational complexity is a serious issue. State-of-the-art methods, especially the phase vocoder based HBE, comes at the prize of a largely increased computational complexity compared to SSB based methods.

As outlined above, existing bandwidth extension schemes apply only one patching method on a given signal block at a time, be it SSB based patching [1-4] or HBE vocoder based patching [15-17]. Additionally, modern audio coders [19-20] offer the possibility of switching the patching method globally on a time block basis between alternative patching schemes.

SSB copy-up patching introduces unwanted roughness into the audio signal, but is computationally simple and preserves the time envelope of transients. In audio codecs employing HBE patching, the transient reproduction quality is often suboptimal. Moreover, the computational complexity is significantly increased over the computational very simple SSB copy-up method.

When it comes to a complexity reduction, sampling rates are of particular importance. This is due to the fact that a high sampling rate means a high complexity and a low sampling rate generally means low complexity due to the reduced number of operations that may be performed. On the other hand, however, the situation in bandwidth extension applications is particularly so that the sampling rate of the core coder output signal will typically be so low that this sampling rate is too low for a full bandwidth signal. Stated differently, when the sampling rate of the decoder output signal is, for example, 2 or 2.5 times the maximum frequency of the core coder output signal, then a bandwidth extension by for example a factor of 2 means that an upsampling operation may be performed so that the sampling rate of the bandwidth extended signal is so high that the sampling can "cover" the additionally generated high frequency components.

Additionally, filterbanks such as analysis filterbanks and synthesis filterbanks are responsible for a considerable amount of processing operations. Hence, the size of the filterbanks, i.e. whether the filterbank is a 32 channel filterbank, a 64 channel filterbank or even a filterbank with a higher number of channels will significantly influence the complexity of the audio processing algorithm. Generally, one can say that a high number of filterbank channel involves more processing operations and, therefore, higher complexity then a small number of filterbank channels. In view of this, in bandwidth extension applications and also in other audio processing applications, where different sampling rates are an issue, such as in vocoder-like applications or any other audio effect applications, there is a specific interdependency between complexity and sampling rate or audio bandwidth, which means that operations for upsampling or subband filtering can drastically enhance the complexity without specifically influencing the audio quality in a good sense when the wrong tools or algorithms are chosen for the specific operations.

In the context of bandwidth extension, parametric data sets are used for performing a spectral envelope adjustment and for performing other manipulations to a signal generated by a patching operation, i.e. by an operation that takes some data from the source range, i.e. from the low band portion of the bandwidth extended signal which is available at the input of the bandwidth extension processor and then maps this data to a high frequency range. Spectral envelope adjustment can take place before actually mapping the low band signal to the high frequency range or subsequently to having mapped the source range to the high frequency range.

Typically, the parametric data sets are provided with a certain frequency resolution, i.e. parametric data refer to frequency bands of the high frequency part. On the other hand, the patching from the low band to the high band, i.e. which source ranges are used for obtaining which target or high frequency ranges, is an operation independent on the resolution, in which the parametric data sets are given with respect to frequency. The fact that the transmitted parametric data are, in a sense, independent from what is actually used as the patching algorithm is an important feature, since this allows great flexibility on the decoder-side, i.e. when it comes to the implementation of the bandwidth extension processor. Here, different patching algorithms can be used, but one and the same spectral envelope adjustment can be performed. Stated differently, the high frequency reconstruction processor or spectral envelope adjustment processor in a bandwidth extension application does not need to have information on the applied patching algorithm in order to perform the spectral envelope adjustment.

A disadvantage of this procedure, however, is that a misalignment between the frequency bands, for which the parametric data sets are provided on the one hand and the spectral borders of a patch on the other hand, can occur. Particularly in situations where the spectral energy strongly changes in the vicinity of a patch border, artifacts may arise specifically in this region, which degrade the quality of the bandwidth extended signal.

SUMMARY

According to an embodiment, an apparatus for processing an audio signal to generate a bandwidth extended signal having a high frequency part and a low frequency part using parametric data for the high frequency part, the parametric data relating to frequency bands of the high frequency part, may have: a patch border calculator for calculating a patch border of a plurality of patch borders such that the patch border coincides with a frequency band border of the frequency bands of the high frequency part; and a patcher for generating a patched signal using the audio signal and the patch border, wherein the patch borders relate to the high frequency part of the bandwidth extended signal; wherein the patch border calculator is configured for: calculating a frequency table defining the frequency bands of the high frequency part using the parametric data or further configuration input data; setting a target synthesis patch border different from the patch border using at least one transposition factor; searching, in the frequency table, for a matching frequency band having a matching border coinciding with the target synthesis patch border within a predetermined matching range, or searching for the frequency band having a frequency band border being closest to the target synthesis patch border; and selecting the matching frequency band as the patch border, wherein the matching frequency band has a matching border coinciding with the target synthesis patch border within a predetermined matching range or has a frequency band border being closest to the target synthesis patch border.

According to another embodiment, a method of processing an audio signal to generate a bandwidth extended signal having a high frequency part and a low frequency part using parametric data for the high frequency part, the parametric data relating to frequency bands of the high frequency part, may have the steps of: calculating a patch border such that the patch border of a plurality of patch borders coincides with a frequency band border of the frequency bands of the high frequency part; and generating a patched signal using the audio signal and the patch border, wherein the patch borders relate to the high frequency part of the bandwidth extended signal, wherein said calculating a patch border may have the steps of calculating a frequency table defining the frequency bands of the high frequency part using the parametric data or further configuration input data; setting a target synthesis patch border different from the patch border using at least one transposition factor; searching, in the frequency table, for a matching frequency band having a matching border coinciding with the target synthesis patch border within a predetermined matching range, or to search for the frequency band having a frequency band border being closest to the target synthesis patch border; and selecting the matching frequency band as the patch border, wherein the matching frequency band has a matching border coinciding with the target synthesis patch border within a predetermined matching range or has a frequency band border being closest to the target synthesis patch border.

Another embodiment may have a computer program having a program code for performing when running on a computer, the method of processing an audio signal to generate a bandwidth extended signal having a high frequency part and a low frequency part using parametric data for the high frequency part, the parametric data relating to frequency bands of the high frequency part, which method may have the steps of: calculating a patch border such that the patch border of a plurality of patch borders coincides with a frequency band border of the frequency bands of the high frequency part; and generating a patched signal using the audio signal and the patch border, wherein the patch borders relate to the high frequency part of the bandwidth extended signal, wherein said calculating a patch border may have the steps of: calculating a frequency table defining the frequency bands of the high frequency part using the parametric data or further configuration input data; setting a target synthesis patch border different from the patch border using at least one transposition factor; searching, in the frequency table, for a matching frequency band having a matching border coinciding with the target synthesis patch border within a predetermined matching range, or to search for the frequency band having a frequency band border being closest to the target synthesis patch border; and selecting the matching frequency band as the patch border, wherein the matching frequency band has a matching border coinciding with the target synthesis patch border within a predetermined matching range or has a frequency band border being closest to the target synthesis patch border.

Embodiments of the present invention relate to an apparatus for processing an audio signal to generate a bandwidth extended signal having a high frequency portion and a low frequency portion, where parametric data for the high frequency portion is used, and where the parametric data relates to frequency bands of the high frequency part. The apparatus comprises a patch border calculator for calculating a patch border such that the patch border coincides with a frequency band border of the frequency bands. The apparatus furthermore comprises a patcher for generating a patch signal using the audio signal and the calculated patch border. In an embodiment, the patch border calculator is configured to calculate the patch border as a frequency border in a synthesis frequency range corresponding to the high frequency part. In this context, the patcher is configured to select a frequency portion of the low band part using a transposition factor and the patch border. In a further embodiment, the patch border calculafor is configured for calculating the patch border using a target patch border not coinciding with a frequency band border of the frequency band. Then, the patch border calculator is configured to set the patch border different from the target patch border in order to obtain the alignment. Particularly in the context of a plurality of patches using different transposition factors, the patch border calculator is configured to calculate patch borders, for example, for three different transposition factors such that each patch border coincides with a frequency band border of the frequency bands of the high frequency part. The patcher is then configured to generate the patch signal using the three different transposition factors such that the border between two adjacent patches coincides with a border between two adjacent frequency bands to which the parametric data is related.

The present invention is particularly useful in that the artifacts arising from misaligned patch borders on the one hand and frequency bands for the parametric data on the other hand are avoided. Instead, due to the perfect alignment, even strongly changing signals or signals having strongly changing portions in the region of the patch border are subjected to bandwidth extension with a good quality.

Furthermore, the present invention is advantageous in that it nevertheless allows high flexibility due to the fact that the encoder does not have to deal with a patching algorithm to be applied on the decoder-side. The independency between patching on the one hand and spectral envelope adjustment, i.e. using the parametric data generated by a bandwidth extension encoder, on the other hand is maintained and allows the application of different patching algorithms or even a combination of different patching algorithms. This is possible, since the patch border alignment makes sure that in the end the patch data on the one hand and the parametric data sets on the other hand match with each other with respect to the frequency bands, which are also called scale factor bands.

Depending on the calculated patch borders which can, for example, relate to the target range, i.e. the high frequency part of the finally obtained bandwidth extended signal, the corresponding source ranges for determining the patch source data from the low band portion of the audio signal are determined. It turns out that only a certain (small) bandwidth of the low band portion of the audio signal may be used due to the fact that in some embodiments harmonic transposition factors are applied. Therefore, in order to efficiently extract this portion from the low band audio signal, a specific analysis filterbank structure relying on cascaded individual filterbanks is used.

Such embodiments rely on a specific cascaded placement of analysis and/or synthesis filterbanks in order to obtain a low complexity resampling without sacrificing audio quality. In an embodiment, an apparatus for processing an input audio signal comprises a synthesis filterbank for synthesizing an audio intermediate signal from the input audio signal, where the input audio signal is represented by a plurality of first subband signals generated by an analysis filterbank placed in processing direction before the synthesis filterbank, wherein a number of filterbank channels of the synthesis filterbank is smaller than a number of channels of the analysis filterbank. The intermediate signal is furthermore processed by a further analysis filterbank for generating a plurality of second subband signals from the audio intermediate signal, wherein the further analysis filterbank has a number of channels being different from the number of channels of the synthesis filterbank so that a sampling rate of a subband signal of the plurality of subband signals is different from a sampling rate of a first subband signal of the plurality of first subband signals generated by the analysis filterbank.

The cascade of a synthesis filterbank and a subsequently connected further analysis filterbank to provides a sampling rate conversion and additionally a modulation of the bandwidth portion of the original audio input signal which has been input into the synthesis filterbank to a base band. This time intermediate signal, that has now been extracted from the original input audio signal which can, for example, be the output signal of a core decoder of a bandwidth extension scheme, is now represented advantageously as a critically sampled signal modulated to the base band, and it has been found that this representation, i.e. the resampled output signal, when being processed by a further analysis filterbank to obtain a subband representation allows a low complexity processing of further processing operations which may or may not occur and which can, for example, be bandwidth extension related processing operations such as non-linear subband operations followed by high frequency reconstruction processing and by a merging of the subbands in the final synthesis filterbank.

The present application provides different aspects of apparatuses, methods or computer programs for processing audio signals in the context of bandwidth extension and in the context of other audio applications, which are not related to bandwidth extension. The features of the subsequently described and claimed individual aspects can be partly or fully combined, but can also be used separately from each other, since the individual aspects already provide advantages with respect to perceptual quality, computational complexity and processor/memory resources when implemented in a computer system or micro processor.

Embodiments provide a method to reduce the computational complexity of a subband block based harmonic HFR method by means of efficient filtering and sampling rate conversion of the input signals to the HFR filter bank analysis stages. Further, the bandpass filters applied to the input signals can be shown to be obsolete in a subband block based transposer.

The present embodiments help to reduce the computational complexity of subband block based harmonic transposition by efficiently implementing several orders of subband block based transposition in the framework of a single analysis and synthesis filter bank pair. Depending on the perceptual quality versus computational complexity trade-off, only a suitable sub-set of orders or all orders of transposition can be performed jointly within a filterbank pair. Furthermore, a combined transposition scheme where only certain transposition orders are calculated directly whereas the remaining bandwidth is filled by replication of available, i.e. previously calculated, transposition orders (e.g. 2" order) and/or the core coded bandwidth. In this case patching can be carried out using every conceivable combination of available source ranges for replication Additionally, embodiments provide a method to improve both high quality harmonic HFR methods as well as subband block based harmonic HFR methods by means of spectral alignment of HFR tools. In particular, increased performance is achieved by aligning the spectral borders of the HFR generated signals to the spectral borders of the envelope adjustment frequency table. Further, the spectral borders of the limiter tool are by the same principle aligned to the spectral borders of the HFR generated signals.

Further embodiments are configured for improving the perceptual quality of transients and at the same time reducing computational complexity by, for example, application of a patching scheme that applies a mixed patching consisting of harmonic patching and copy-up patching.

In specific embodiments, the individual filterbanks of the cascaded filterbank structure are quadrature mirror filterbanks (QMF), which all rely on a lowpass prototype filter or window modulated using a set of modulation frequencies defining the center frequencies of the filterbank channels. Advantageously, all window functions or prototype filters depend on each other in such a way that the filters of the filterbanks with different sizes (filterbank channels) depend on each other as well. Advantageously, the largest filterbank in a cascaded structure of filterbanks comprising, in embodiments, a first analysis filterbank, a subsequently connected filterbank, a further analysis filterbank, and at some later state of processing a final synthesis filter bank, has a window function or prototype filter response having a certain number of window function or prototype filter coefficients. The smaller sized filterbanks are all sub-sampled versions of this window function, which means that the window functions for the other filterbanks are sub-sampled versions of the "large" window function. For example, if a filterbank has half the size of the large filterbank, then the window function has half the number of coefficients, and the coefficients of the smaller sized filterbanks are derived by sub-sampling. In this situation, the sub-sampling means that e.g. every second filter coefficient is taken for the smaller filterbank having half the size. However, when there are other relations between the filterbank sizes which are non-integer valued, then a certain kind of interpolation of the window coefficients is performed so that in the end the window of the smaller filterbank is again a sub-sampled version of the window of the larger filterbank.

Embodiments of the present invention are particularly useful in situations where only a portion of the input audio signal may be used for further processing, and this situation particularly occurs in the context of harmonic bandwidth extension. In this context, vocoder-like processing operations are particularly advantageous.

It is an advantage of embodiments that the embodiments provide a lower complexity for a QMF transposer by efficient time and frequency domain operations and an improved audio quality for QMF and DFT based harmonic spectral band replication using spectral alignment.

Embodiments relate to audio source coding systems employing an e.g. subband block based harmonic transposition method for high frequency reconstruction (HFR), and to digital effect processors, e.g. so-called exciters, where generation of harmonic distortion adds brightness to the processed signal, and to time stretchers, where the duration of a signal is extended while maintaining the spectral content of the original. Embodiments provide a method to reduce the computational complexity of a subband block based harmonic HFR method by means of efficient filtering and sampling rate conversion of the input signals prior to the HFR filter bank analysis stages. Further, embodiments show that the conventional bandpass filters applied to the input signals are obsolete in a subband block based HFR system. Additionally, embodiments provide a method to improve both high quality harmonic HFR methods as well as sub-band block based harmonic HFR methods by means of spectral alignment of HFR tools. In particular, embodiments teach how increased performance is achieved by aligning the spectral borders of the HFR generated signals to the spectral borders of the envelope adjustment frequency table. Further, the spectral borders of the limiter tool are by the same principle aligned to the spectral borders of the HFR generated signals.

BRIEF DESCRIPTION OF THE DRAWINGS

Embodiments of the present invention will be detailed subsequently referring to the appended drawings, in which:

FIG. 24*a* illustrates an advantageous implementation of the patch border calculator of FIG. 23;

DETAILED DESCRIPTION OF THE INVENTION

The below-described embodiments are merely illustrative and may provide a lower complexity of a QMF transposer by efficient time and frequency domain operations, and improved audio quality of both QMF and DFT based harmonic SBR by spectral alignment. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Figure 23:
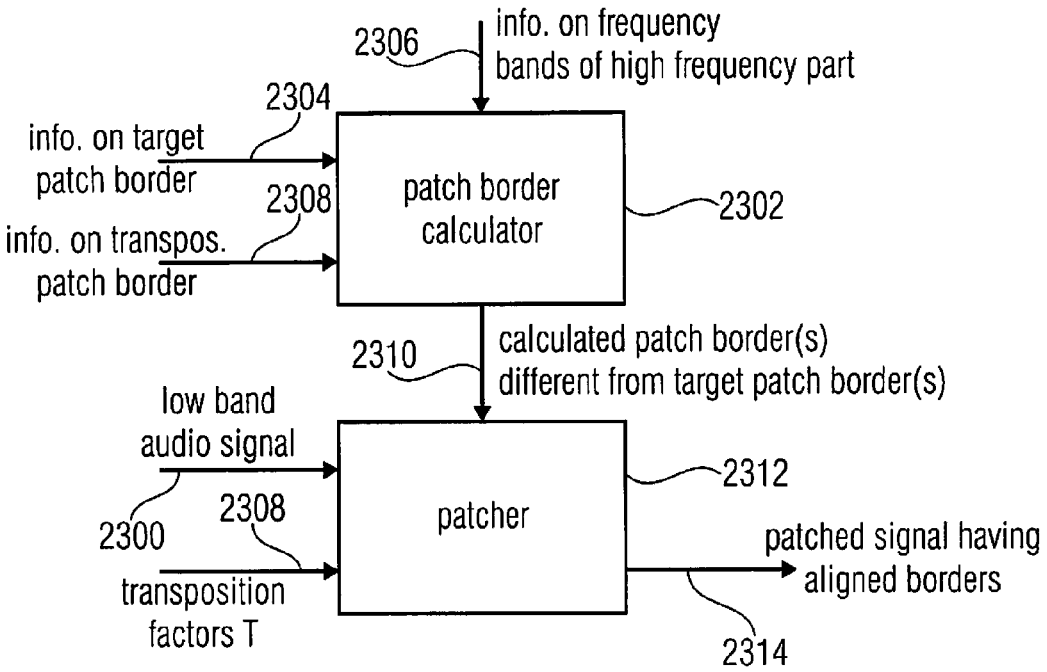
FIG. 23 illustrates an overview of an apparatus for processing an audio signal using spectral band alignment in accordance with an embodiment.

FIG. 23 illustrates an embodiment of an apparatus for processing an audio signal 2300 to generate a bandwidth extended signal having a high frequency part and a low frequency part using parametric data for the high frequency part, where the parametric data relates to frequency bands of the high frequency part. The apparatus comprises a patch border calculator 2302 for calculating a patch border advantageously using a target patch border 2304 not coinciding with a frequency band border of the frequency band. The information 2306 on the frequency bands of the high frequency part can, for example, be taken from an encoded data stream suited for bandwidth extension. In a further embodiment, the patch border calculator does not only calculate a single patch border for a single patch but calculates several patch borders for several different patches which belong to different transposition factors, where the information on the transposition factors are provided to the patch border calculator 2302 as indicated at 2308. The patch border calculator is configured to calculate the patch borders so that a patch border coincides with a frequency band border of the frequency bands. Advantageously, when the patch border calculator receives information 2304 on a target patch border, then the patch border calculator is configured for setting the patch border different from the target patch border in order to obtain the alignment. The patch border calculator outputs the calculated patch borders, which are different from target patch borders, at line 2310 to a patcher 2312. The patcher 2312 generates a patched signal or several patched signals at output 2314 using the low band audio signal 2300 and the patch borders at 2310, and in embodiments where multiple transpositions are performed, using the transposition factors on line 2308.

The table in FIG. 23 illustrates one numerical example for illustrating the basic concept. For example, when it is assumed that the low band audio signal has a low frequency portion extending from 0 to 4 kHz (it is clear that the source range does not actually begin at 0 Hz, but close to 0, such as at 20 Hz). Furthermore, it is the user's intention to perform a bandwidth extension of the 4 kHz signal to a 16 kHz bandwidth extended signal. Additionally, the user has indicated that the user wishes to perform a bandwidth extension using three harmonic patches with transposition factors of 2, 3, and 4. Then, the target borders of the patches can be set to a first patch extending from 4 to 8 kHz, a second patch extending from 8 to 12 kHz, and a third patch extending from 12 to 16 kHz. Thus, the patch borders are 8, 12 and 16 when it is assumed that the first patch border coinciding with the maximum or crossover frequency of the low frequency band signal is not changed. However, changing this border of the first patch is also within embodiments of the present invention if it may be used. The target borders would correspond to a source range of 2 to 4 kHz for the transposition factor of 2, 2.66 to 4 kHz for the transposition factor of 3, and 3 to 4 kHz for the transposition factor of 4. Specifically, the source range is calculated by dividing the target borders by the actually used transposition factor.

For the example in FIG. 23 it is assumed that the borders 8, 12, 16 do not coincide with the frequency band borders of the frequency bands to which the parametric input data is related. Hence, the patch border calculator calculates aligned patch borders and does not immediately apply the target borders. This may result in an upper patch border of 7.7 kHz for the first patch, an upper border of 11.9 kHz for the second patch and 15.8 kHz as the upper border for the third patch. Then, using the transposition factor again for the individual patch, certain "adjusted" source ranges are calculated and used for patching, which are exemplarily indicated in FIG. 23.

Although it has been outlined that the source ranges are changed together with the target ranges, for other implementations one could also manipulate the transposition factor and to maintain the source range or the target borders or for other applications one could even change the source range and the transposition factor in order to finally arrive at adjusted patch borders which coincide with frequency band borders of frequency bands to which the parametric bandwidth extension data describing the spectral envelope of the high band portion of the original signal are related.

Figure 14:
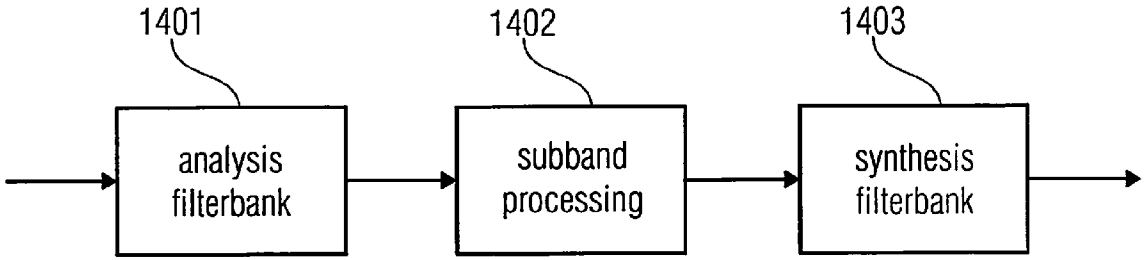
FIG. 14 illustrates the principle of subband block based harmonic transposition.

FIG. 14 illustrates the principle of subband block based transposition. The input time domain signal is fed to an analysis filterbank 1401 which provides a multitude of complex valued subband signals. These are fed to the subband processing unit 1402. The multitude of complex valued output subbands is fed to the synthesis filterbank 1403, which in turn outputs the modifeed time domain signal. The subband processing unit 1402 performs nonlinear block based subband processing operations such that the modified time domain signal is a transposed version of the input signal corresponding to a transposition order T>1. The notion of a block based subband processing is defined by comprising nonlinear operations on blocks of more than one subband sample at a time, where subsequent blocks are windowed and overlap added to generate the output subband signals.

The filterbanks 1401 and 1403 can be of any complex exponential modulated type such as QMF or a windowed DFT. They can be evenly or oddly stacked in the modulation and can be defined from a wide range of prototype filters or windows. It is important to know the quotient $\Delta f_S/\Delta f_A$ of the following two filter bank parameters, measured in physical units.

$\Delta f_A$: the subband frequency spacing of the analysis filterbank 1401;

$\Delta f_S$: the subband frequency spacing of the synthesis filterbank 1403.

For the configuration of the subband processing 1402 it is useful to find the correspondence between source and target subband indices. It is observed that an input sinusoid of physical frequency $\Omega$ will result in a main contribution occurring at input subbands with index $n \approx \Omega/\Delta f_A$. An output sinusoid of the desired transposed physical frequency $T \cdot \Omega$ will result from feeding the synthesis subband with index $m \approx T \cdot \Omega/\Delta f_S$. Hence, the appropriate source subband index values of the subband processing for a given target subband index m obeys $$n \approx \frac{\Delta f_S}{\Delta f_A} \cdot \frac{1}{T} m. \tag{1}$$

Figure 15:
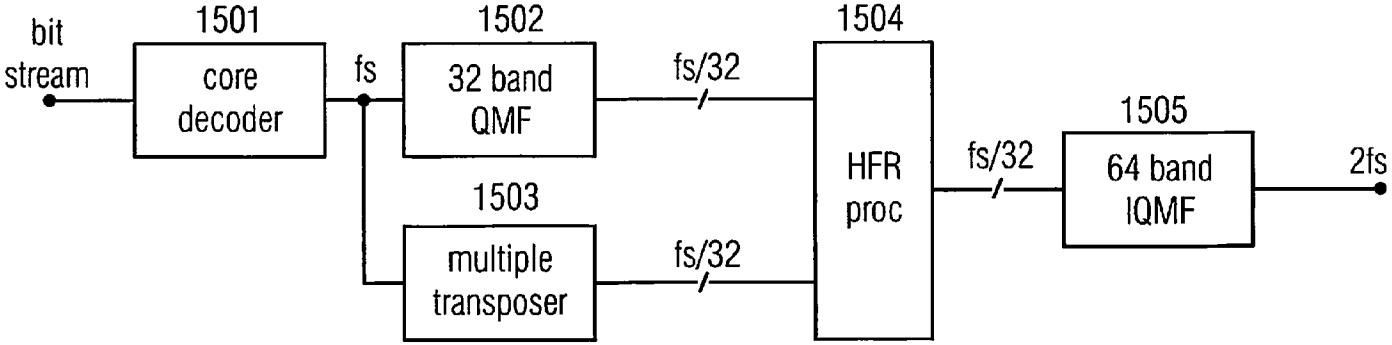
FIG. 15 illustrates an example scenario for the application of subband block based transposition using several orders of transposition in a HFR enhanced audio codec.

FIG. 15 illustrates an example scenario for the application of subband block based transposition using several orders of transposition in a HFR enhanced audio codec. A transmitted bitstream is received at the core decoder 1501, which provides a low bandwidth decoded core signal at a sampling frequency $f_S$. The low frequency is resampled to the output sampling frequency $2f_S$ by means of a complex modulated 32 band QMF analysis bank 1502 followed by a 64 band QMF synthesis bank (Inverse QMF) 1505. The two filterbanks 1502 and 1505 have the same physical resolution parameters $\Delta f_S = \Delta f_A$ and the HFR processing unit 1504 simply lets through the unmodified lower subbands corresponding to the low bandwidth core signal. The high frequency content of the output signal is obtained by feeding the higher subbands of the 64 band QMF synthesis bank 1505 with the output bands from the multiple transposer unit 1503, subject to spectral shaping and modification performed by the HFR processing unit 1504. The multiple transposer 1503 takes as input the decoded core signal and outputs a multitude of subband signals which represent the 64 QMF band analysis of a superposition or combination of several transposed signal components. The objective is that if the HFR processing is bypassed, each component corresponds to an integer physical transposition of the core signal, (T=2,3, . . . ).

Figure 16:
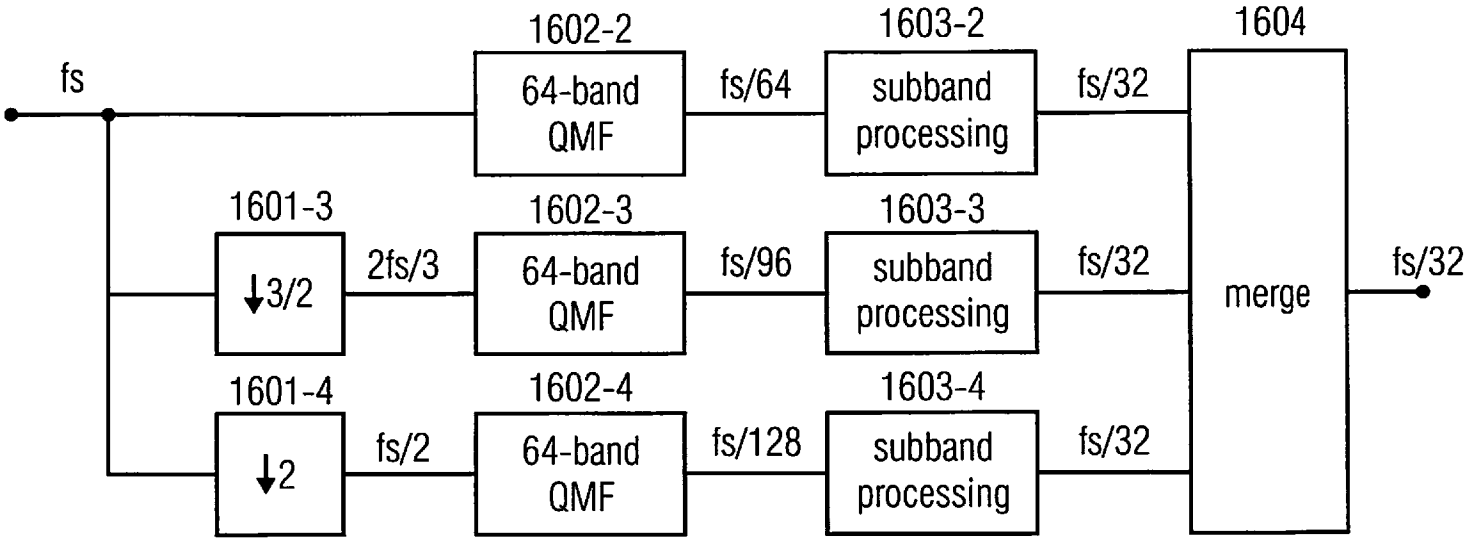
FIG. 16 illustrates a conventional-technology example scenario for the operation of a multiple order subband block based transposition applying a separate analysis filter bank per transposition order.

FIG. 16 illustrates a conventional-technology example scenario for the operation of a multiple order subband block based transposition 1603 applying a separate analysis filter bank per transposition order. Here three transposition orders T=2,3,4 are to be produced and delivered in the domain of a 64 band QMF operating at output sampling rate $2f_S$. The merge unit 1604 simply selects and combines the relevant subbands from each transposition factor branch into a single multitude of QMF subbands to be fed into the HFR processing unit.

Consider first the case T=2. The objective is specifically that the processing chain of a 64 band QMF analysis 1602-2, a subband processing unit 1603-2, and a 64 band QMF synthesis 1505 results in a physical transposition of T=2. Identifying these three blocks with 1401, 1402 and 1403 of FIG. 14, one finds that and $\Delta f_S/\Delta f_A=2$ such that (1) results in the specification for 1603-2 that the correspondence between source nand target subbands m is given by n=m.

For the case T=3, the exemplary system includes a sampling rate converter 1601-3 which converts the input sampling rate down by a factor 3/2 from $f_S$ to $2f_S/3$. The objective is specifically that the processing chain of the 64 band QMF analysis 1602-3, the subband processing unit 1603-3, and a 64 band QMF synthesis 1505 results in a physical transposition of T=3. By identifying these three blocks with 1401, 1402 and 1403 of FIG. 14, one finds due to the resampling that $\Delta f_S/\Delta f_A=3$, such that (1) provides the specification for 1603-3, where the correspondence between source nand target subbands m is again given by n=m.

For the case T=4, the exemplary system includes a sampling rate converter 1601-4 which converts the input sampling rate down by a factor two from $f_S$ to $f_S/2$. The objective is specifically that the processing chain of the 64 band QMF analysis 1602-4, the subband processing unit 1603-4, and a 64 band QMF synthesis 1505 results in a physical transposition of T=4. By identifying these three blocks with 1401, 1402 and 1403 of FIG. 14, one finds due to the resampling that $\Delta f_S/\Delta f_A=4$, such that (1) provides the specification for 1603-4, where the correspondence between source nand target subbands m is also given by n=m .

Figure 17:
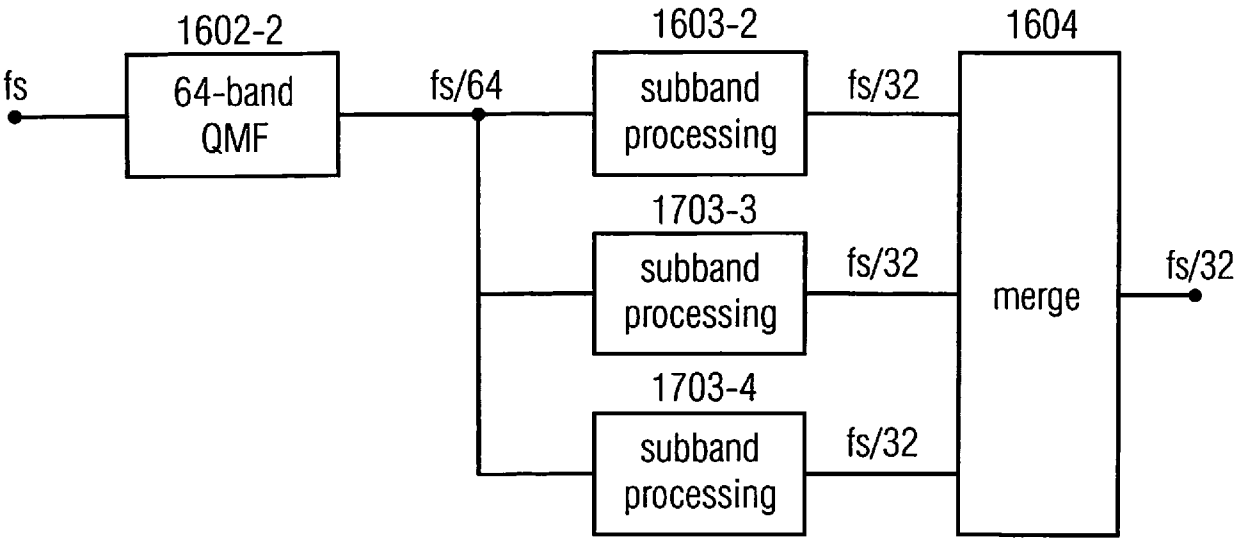
FIG. 17 illustrates an inventive example scenario for the efficient operation of a multiple order subband block based transposition applying a single 64 band QMF analysis filter bank.

FIG. 17 illustrates an inventive example scenario for the efficient operation of a multiple order subband block based transposition applying a single 64 band QMF analysis filter bank. Indeed, the use of three separate QMF analysis banks and two sampling rate converters in FIG. 16 results in a rather high computational complexity, as well as some implementation disadvantages for frame based processing due to the sampling rate conversion 1601-3. The current embodiments teaches to replace the two branches 1601-3→1602-3→1603-3 and 1601-4→1602-4→1603-4 by the subband processing 1703-3 and 1703-4, respectively, whereas the branch 1602-2→1603-2 is kept unchanged compared to FIG. 16. All three orders of transposition will now have to be performed in a filterbank domain with reference to FIG. 14, where $\Delta f_S/\Delta f_A=2$. For the case T=3 , the specification for 1703-3 given by (1) is that the correspondence between source nand target subbands m is given by $n \approx 2m/3$. For the case T=4, the specifications for 1703-4 given by (1) is that the correspondence between source n and target subbands m is given by n≈2m. To further reduce complexity, some transposition orders can be generated by copying already calculated transposition orders or the output of the core decoder.

Figure 1:
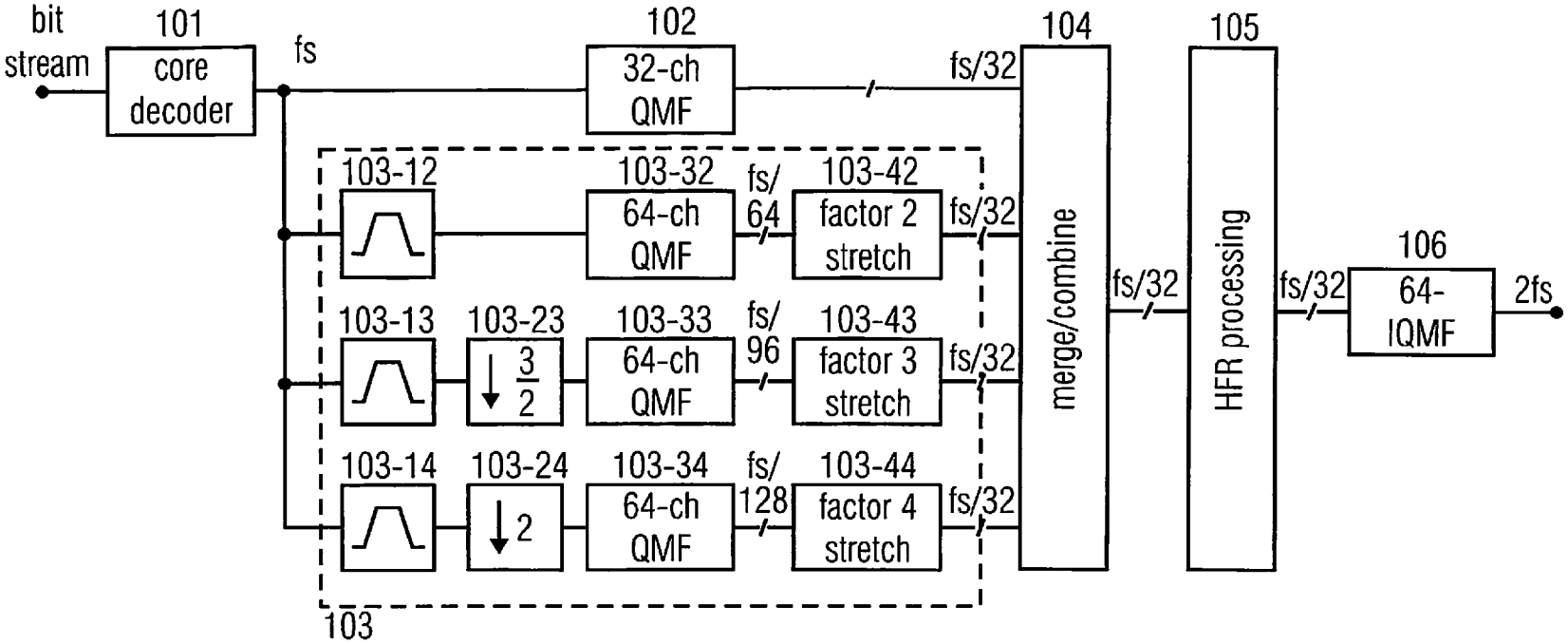
FIG. 1 illustrates the operation of a block based transposer using transposition orders of 2, 3, and 4 in a HFR enhanced decoder framework.

FIG. 1 illustrates the operation of a subband block based transposer using transposition orders of 2, 3, and 4 in a I-IFR enhanced decoder framework, such as SBR [ISO/IEC 14496-3:2009, "Information technology—Coding of audio-visual objects—Part 3: Audio]. The bitstream is decoded to the time domain by the core decoder 101 and passed to the HFR module 103, which generates a high frequency signal from the base band core signal. After generation, the HFR generated signal is dynamically adjusted to match the original signal as close as possible by means of transmitted side information. This adjustment is performed by the HFR processor 105 on subband signals, obtained from one or several analysis QMF banks. A typical scenario is where the core decoder operates on a time domain signal sampled at half the frequency of the input and output signals, i.e. the HFR decoder module will effectively resample the core signal to twice the sampling frequency. This sample rate conversion is usually obtained by the first step of filtering the core coder signal by means of a 32-band analysis QMF bank 102. The subbands below the so-called crossover frequency, i.e. the lower subset of the 32 subbands that contains the entire core coder signal energy, are combined with the set of subbands that carry the HFR generated signal. Usually, the number of so combined subbands is 64, which, after filtering through the synthesis QMF bank 106, results in a sample rate converted core coder signal combined with the output from the HFR module.

In the subband block based transposer of the HFR module 103, three transposition orders T=2, 3 and 4, are to be produced and delivered in the domain of a 64 band QMF operating at output sampling rate $2f_S$. The input time domain signal is bandpass filtered in the blocks 103-12, 103-13 and 103-14. This is done in order to make the output signals, processed by the different transposition orders, to have non-overlapping spectral contents. The signals are further downsampled (103-23, 103-24) to adapt the sampling rate of the input signals to fit analysis filter banks of a constant size (in this case 64). It can be noted that the increase of the sampling rate, from $f_S$ to $2f_S$, can be explained by the fact that the sampling rate converters use downsampling factors of T/2 instead of T, in which the latter would result in transposed sub-band signals having equal sampling rate as the input signal. The downsampled signals are fed to separate HFR analysis filter banks (103-32, 103-33 and 103-34), one for each transposition order, which provide a multitude of complex valued subband signals. These are fed to the non-linear subband stretching units (103-42, 103-43 and 103-44). The multitude of complex valued output subbands are fed to the Merge/Combine module 104 together with the output from the subsampled analysis bank 102. The Merge/Combine unit simply merges the sub-bands from the core analysis filter bank 102 and each stretching factor branch into a single multitude of QMF subbands to be fed into the HFR processing unit 105.

When the signal spectra from different transposition orders are set to not overlap, i.e. the spectrum of the $7^{th}$ transposition order signal should start where the spectrum from the T-1 order signal ends, the transposed signals need to be of bandpass character. Hence the traditional bandpass filters 103-12-103-14 in FIG. 1. However, through a simple exclusive selection among the available subbands by the Merge/Combine unit 104, the separate bandpass filters are redundant and can be avoided. Instead, the inherent bandpass characteristic provided by the QMF bank is exploited by feeding the different contributions from the transposer branches independently to different subband channels in 104. It also suffices to apply the time stretching only to bands which are combined in 104.

Figure 2:
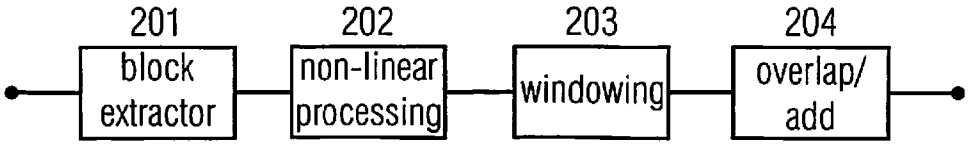
FIG. 2 illustrates the operation of the nonlinear subband stretching units in FIG. 1.

FIG. 2 illustrates the operation of a nonlinear subband stretching unit. The block extractor 201 samples a finite frame of samples from the complex valued input signal. The frame is defined by an input pointer position. This frame undergoes nonlinear processing in 202 and is subsequently windowed by a finite length window in 203. The resulting samples are added to previously output samples in the overlap and add unit 204 where the output frame position is defined by an output pointer position. The input pointer is incremented by a fixed amount and the output pointer is incremented by the subband stretch factor times the same amount. An iteration of this chain of operations will produce an output signal with duration being the sub-band stretch factor times the input subband signal duration, up to the length of the synthesis window.

While the SSB transposer employed by SBR [ISO/IEC 14496-3:2009, "Information technology—Coding of audio-visual objects—Part 3: Audio] typically exploits the entire base band, excluding the first subband, to generate the high band signal, a harmonic transposer generally uses a smaller part of the core coder spectrum. The amount used, the so-called source range, depends on the transposition order, the bandwidth extension factor, and the rules applied for the combined result, e.g. if the signals generated from different transposition orders are allowed to overlap spectrally or not. As a consequence, just a limited part of the harmonic transposer output spectrum for a given transposition order will actually be used by the HFR processing module 105.

Figure 18:
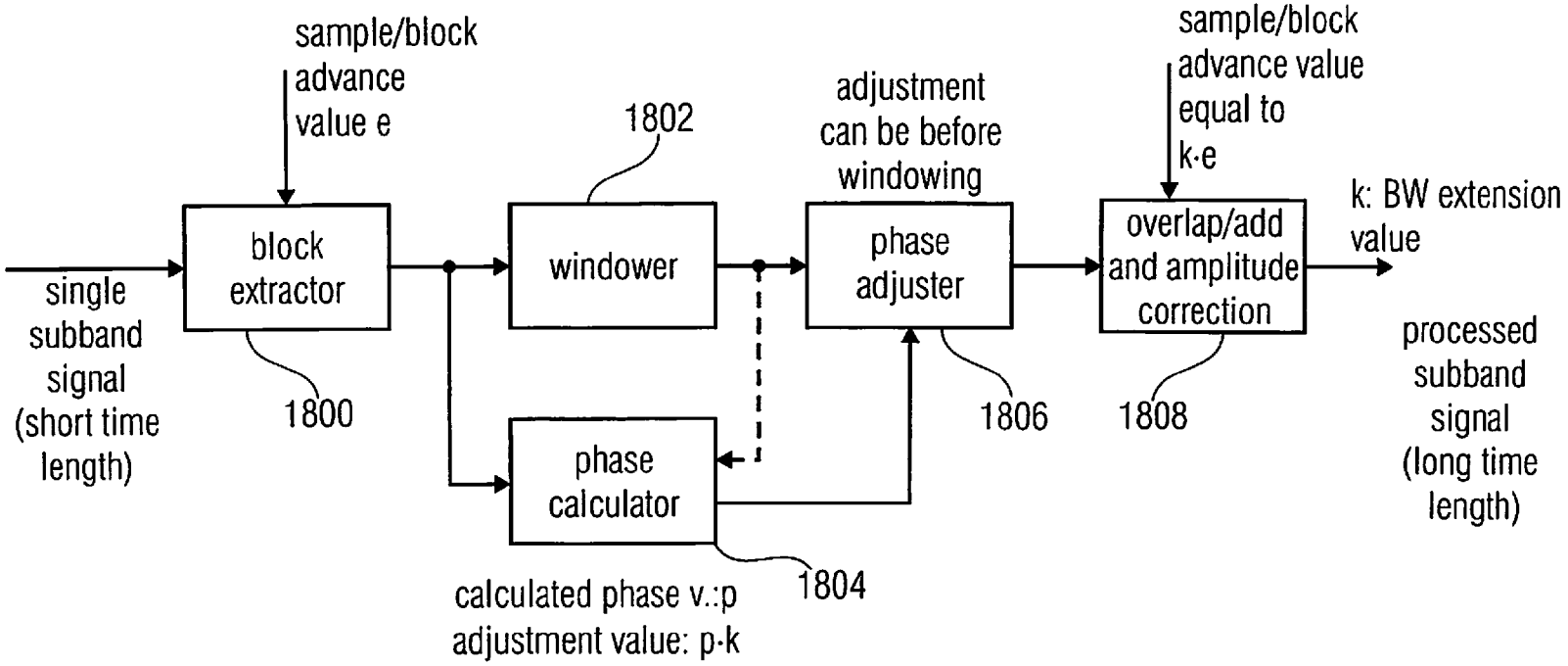
FIG. 18 illustrates another example for forming a subband signal-wise processing.
Figure 19:
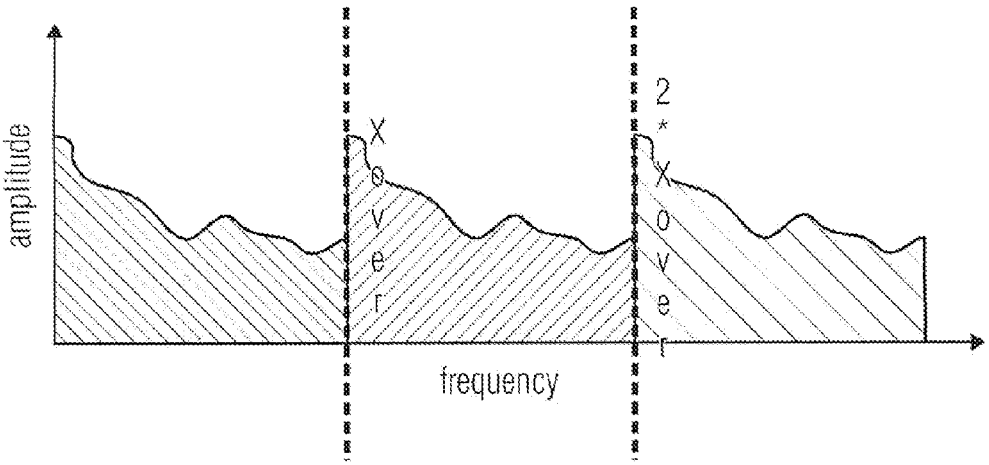
FIG. 19 illustrates a single sideband modulation (SSB) patching.
Figure 20:
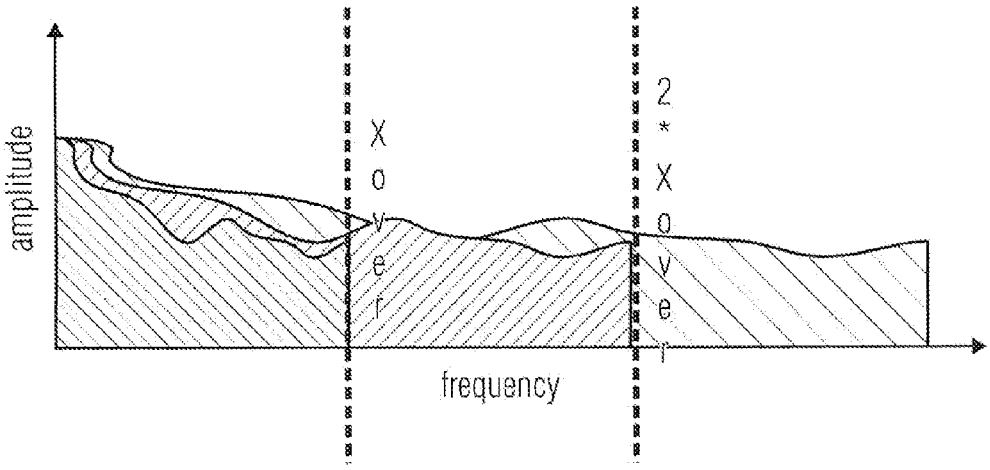
FIG. 20 illustrates a harmonic bandwidth extension (HBE) patching.

FIG. 18 illustrates another embodiment of an exemplary processing implementation for processing a single subband signal. The single subband signal has been subjected to any kind of decimation either before or after being filtered by an analysis filter bank not shown in FIG. 18.

Therefore, the time length of the single subband signal is shorter than the time length before forming the decimation. The single subband signal is input into a block extractor 1800, which can be identical to the block extractor 201, but which can also be implemented in a different way. The block extractor 1800 in FIG. 18 operates using a sample/block advance value exemplarily called e. The sample/block advance value can be variable or can be fixedly set and is illustrated in FIG. 18 as an arrow into block extractor box 1800. At the output of the block extractor 1800, there exists a plurality of extracted blocks. These blocks are highly overlapping, since the sample/block advance value e is significantly smaller than the block length of the block extractor. An example is that the block extractor extracts blocks of 12 samples. The first block comprises samples 0 to 11, the second block comprises samples 1 to 12, the third block comprises samples 2 to 13, and so on. In this embodiment, the sample/block advance value e is equal to 1, and there is a 11-fold overlapping.

The individual blocks are input into a windower 1802 for windowing the blocks using a window function for each block. Additionally, a phase calculator 1804 is provided, which calculates a phase for each block. The phase calculator 1804 can either use the individual block before windowing or subsequent to windowing. Then, a phase adjustment value p×k is calculated and input into a phase adjuster 1806. The phase adjuster applies the adjustment value to each sample in the block. Furthermore, the factor k is equal to the bandwidth extension factor. When, for example, the bandwidth extension by a factor 2 is to be obtained, then the phase p calculated for a block extracted by the block extractor 1800 is multiplied by the factor 2 and the adjustment value applied to each sample of the block in the phase adjustor 1806 is p multiplied by 2. This is an exemplary value/rule. Alternatively, the corrected phase for synthesis is k*p, p+(k−1)*p. So in this example the correction factor is either 2, if multiplied or 1*p if added. Other values/rules can be applied for calculating the phase correction value.

In an embodiment, the single subband signal is a complex subband signal, and the phase of a block can be calculated by a plurality of different ways. One way is to take the sample in the middle or around the middle of the block and to calculate the phase of this complex sample. It is also possible to calculate the phase for every sample.

Although illustrated in FIG. 18 in the way that a phase adjustor operates subsequent to the windower, these two blocks can also be interchanged, so that the phase adjustment is performed to the blocks extracted by the block extractor and a subsequent windowing operation is performed. Since both operations, i.e., windowing and phase adjustment are real-valued or complex-valued multiplications, these two operations can be summarized into a single operation using a complex multiplication factor, which, itself, is the product of a phase adjustment multiplication factor and a windowing factor.

The phase-adjusted blocks are input into an overlap/add and amplitude correction block 1808, where the windowed and phase-adjusted blocks are overlap-added. Importantly, however, the sample/block advance value in block 1808 is different from the value used in the block extracfor 1800. Particularly, the sample/block advance value in block 1808 is greater than the value e used in block 1800, so that a time stretching of the signal output by block 1808 is obtained. Thus, the processed subband signal output by block 1808 has a length which is longer than the subband signal input into block 1800. When the bandwidth extension of two is to be obtained, then the sample/block advance value is used, which is two times the corresponding value in block 1800. This results in a time stretching by a factor of two. When, however, other time stretching factors may be used, then other sample/block advance values can be used so that the output of block 1808 has a useful time length.

For addressing the overlap issue, an amplitude correction is advantageously performed in order to address the issue of different overlaps in block 1800 and 1808. This amplitude correction could, however, be also introduced into the windower/phase adjustor multiplication factor, but the amplitude correction can also be performed subsequent to the overlap/processing.

In the above example with a block length of 12 and a sample/block advance value in the block extractor of one, the sample/block advance value for the overlap/add block 1808 would be equal to two, when a bandwidth extension by a factor of two is performed. This would still result in an overlap of five blocks. When a bandwidth extension by a factor of three is to be performed, then the sample/block advance value used by block 1808 would be equal to three, and the overlap would drop to an overlap of three. When a four-fold bandwidth extension is to be performed, then the overlap/add block 1808 would have to use a sample/block advance value of four, which would still result in an overlap of more than two blocks.

Figure 3:
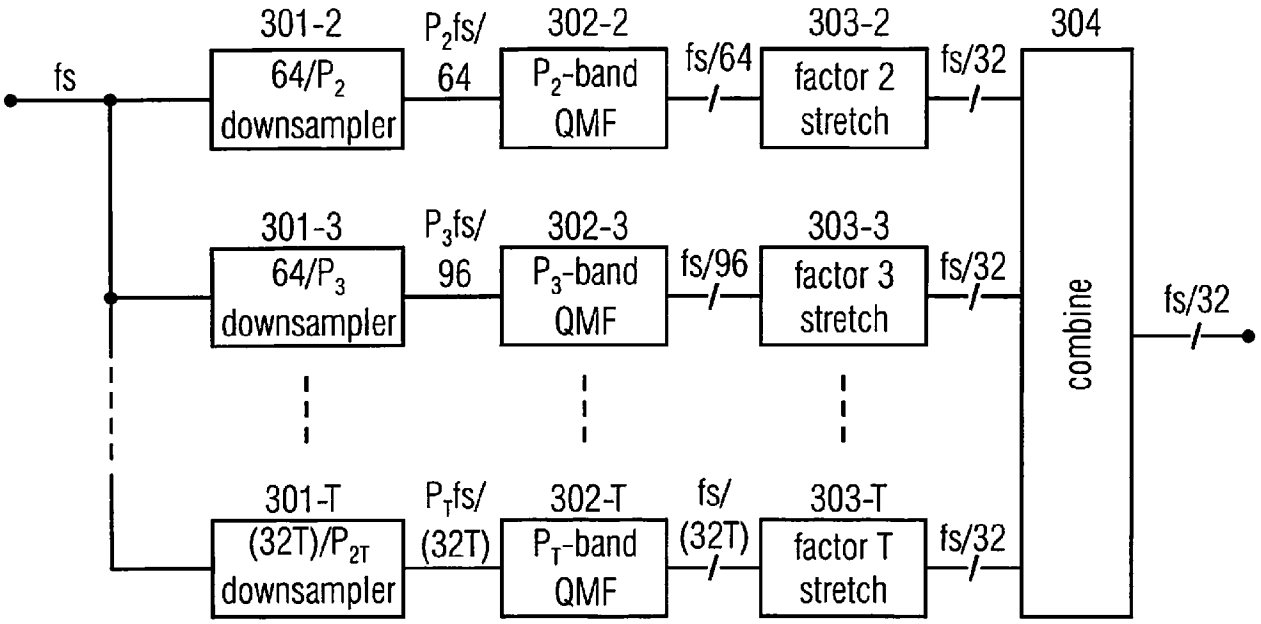
FIG. 3 illustrates an efficient implementation of the block based transposer of FIG. 1, where the resamplers and bandpass filters preceding the HFR analysis filter banks are implemented using multi-rate time domain resamplers and QMF based bandpass filters.

Large computational savings can be achieved by restricting the input signals to the transposer branches to solely contain the source range, and this at a sampling rate adapted to each transposition order. The basic block scheme of such a system for a subband block based HFR generator is illustrated in FIG. 3. The input core coder signal is processed by dedicated downsampiers preceding the HFR analysis filter banks.

The essential effect of each downsampler is to filter out the source range signal and to deliver that to the analysis filter bank at the lowest possible sampling rate. Here, lowest possible refers to the lowest sampling rate that is still suitable for the downstream processing, not necessarily the lowest sampling rate that avoids aliasing after decimation. The sampling rate conversion may be obtained in various manners. Without limiting the scope of the invention, two examples will be given: the first shows the resampling performed by multi-rate time domain processing, and the second illustrates the resampling achieved by means of QMF subband processing.

Figure 4:
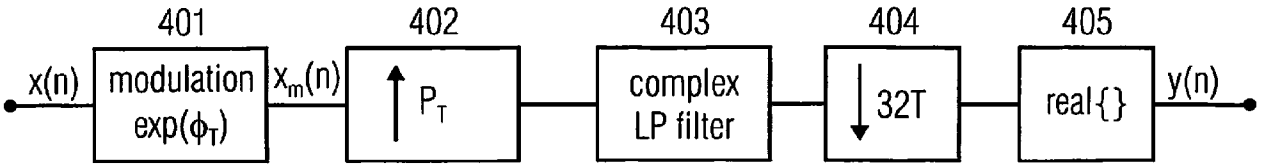
FIG. 4 illustrates an example of building blocks for an efficient implementation of a multi-rate time domain resampler of FIG. 3.
Figure 5A:
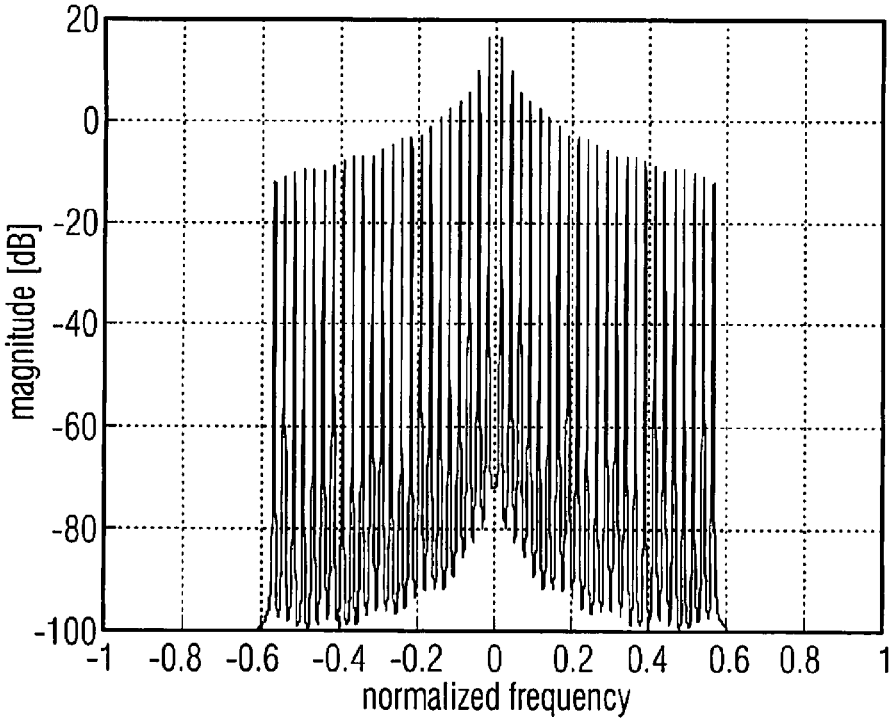
FIG. 5 illustrates the effect on an example signal processed by the different blocks of FIG. 4 for a transposition order of 2.
Figure 5B:
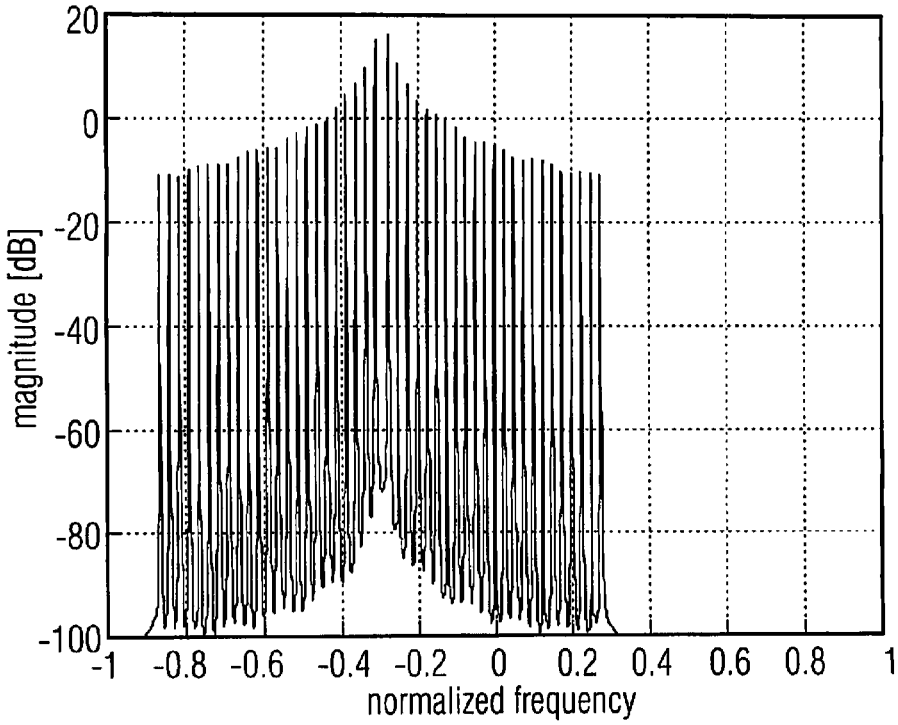
Figure 5C:
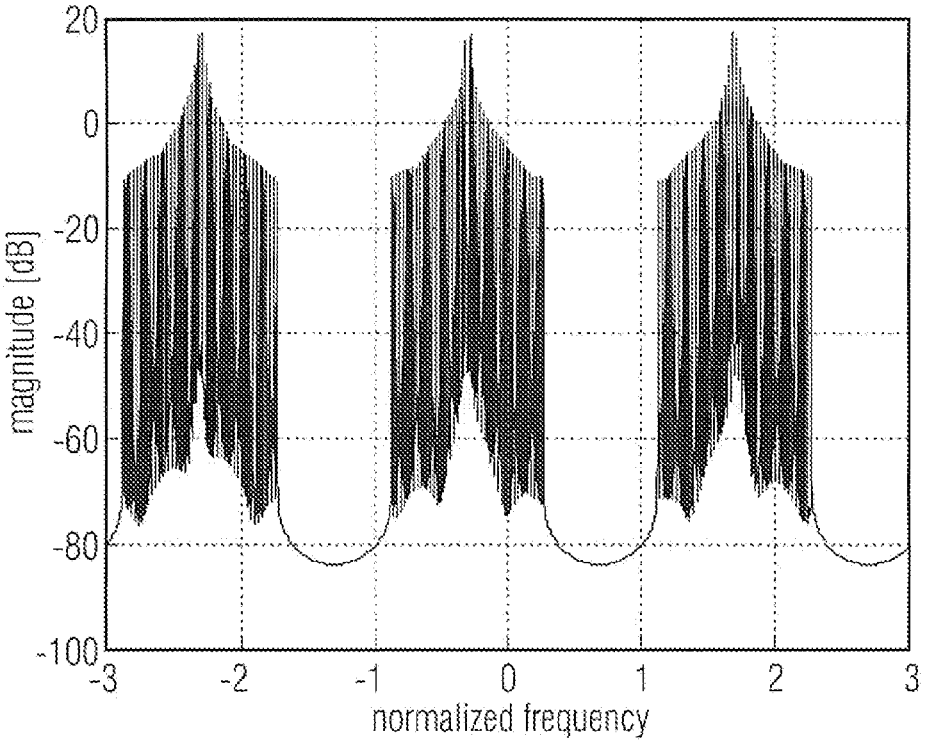
Figure 5D:
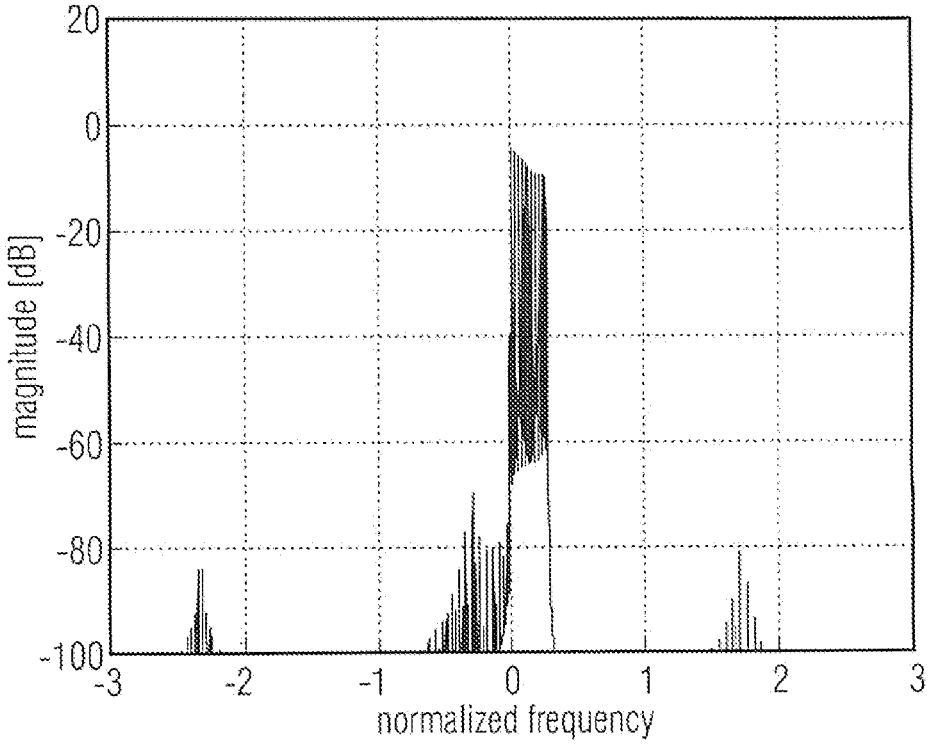
Figure 5E:
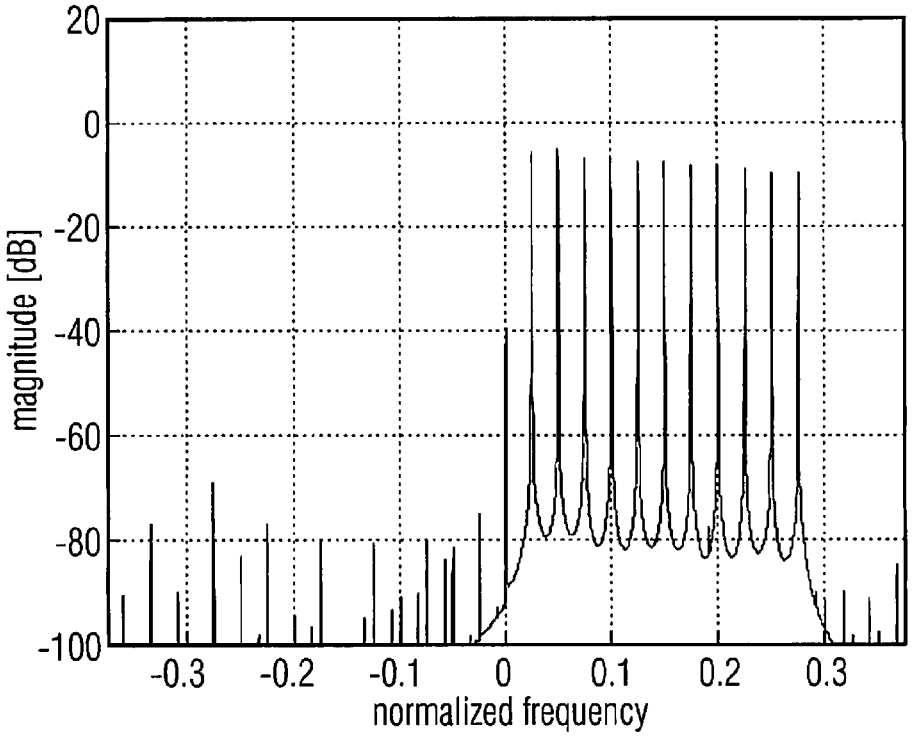
Figure 5F:
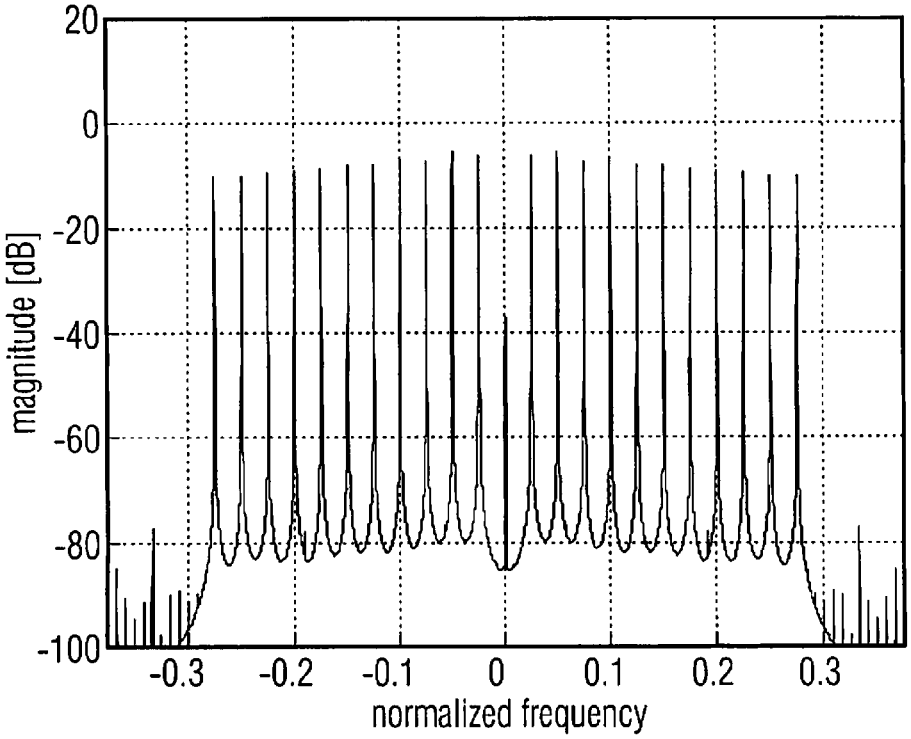

FIG. 4 shows an example of the blocks in a multi-rate time domain downsampler for a transposition order of 2. The input signal, having a bandwidth B Hz, and a sampling frequency $f_S$, is modulated by a complex exponential (401) in order to frequency-shift the start of the source range to DC frequency as $$x_m(n) = x(n) \cdot \exp\left(-i2\pi f_s \frac{B}{2}\right)$$

Examples of an input signal and the spectrum after modulation is depicted in FIGS. 5(*a*) and (b). The modulated signal is interpolated (402) and filtered by a complex-valued low-pass filter with passband limits 0 and B/2 Hz (403). The spectra after the respective steps are shown in FIGS. 5(*c*) and (d). The filtered signal is subsequently decimated (404) and the real part of the signal is computed (405). The results after these steps are shown in FIGS. 5(*e*) and (*f*). In this particular example, when T=2, B=0.6 (on a normalized scale, i.e. $f_S$=2), $P_2$ is chosen as 24, in order to safely cover the source range. The downsampling factor gets $$\frac{32T}{P_2} = \frac{64}{24} = \frac{8}{3},$$

where the fraction has been reduced by the common factor 8. Hence, the interpolation factor is 3 (as seen from FIG. 5(*c*)) and the decimation factor is 8. By using the Noble Identities ["Multirate Systems And Filter Banks," P.P. Vaidyanathan, 1993, Prentice Hall, Englewood Cliffs], the decimator can be moved all the way to the left, and the interpolator all the way to the right in FIG. 4. In this way, the modulation and filtering are done on the lowest possible sampling rate and computational complexity is further decreased.

Figure 6:
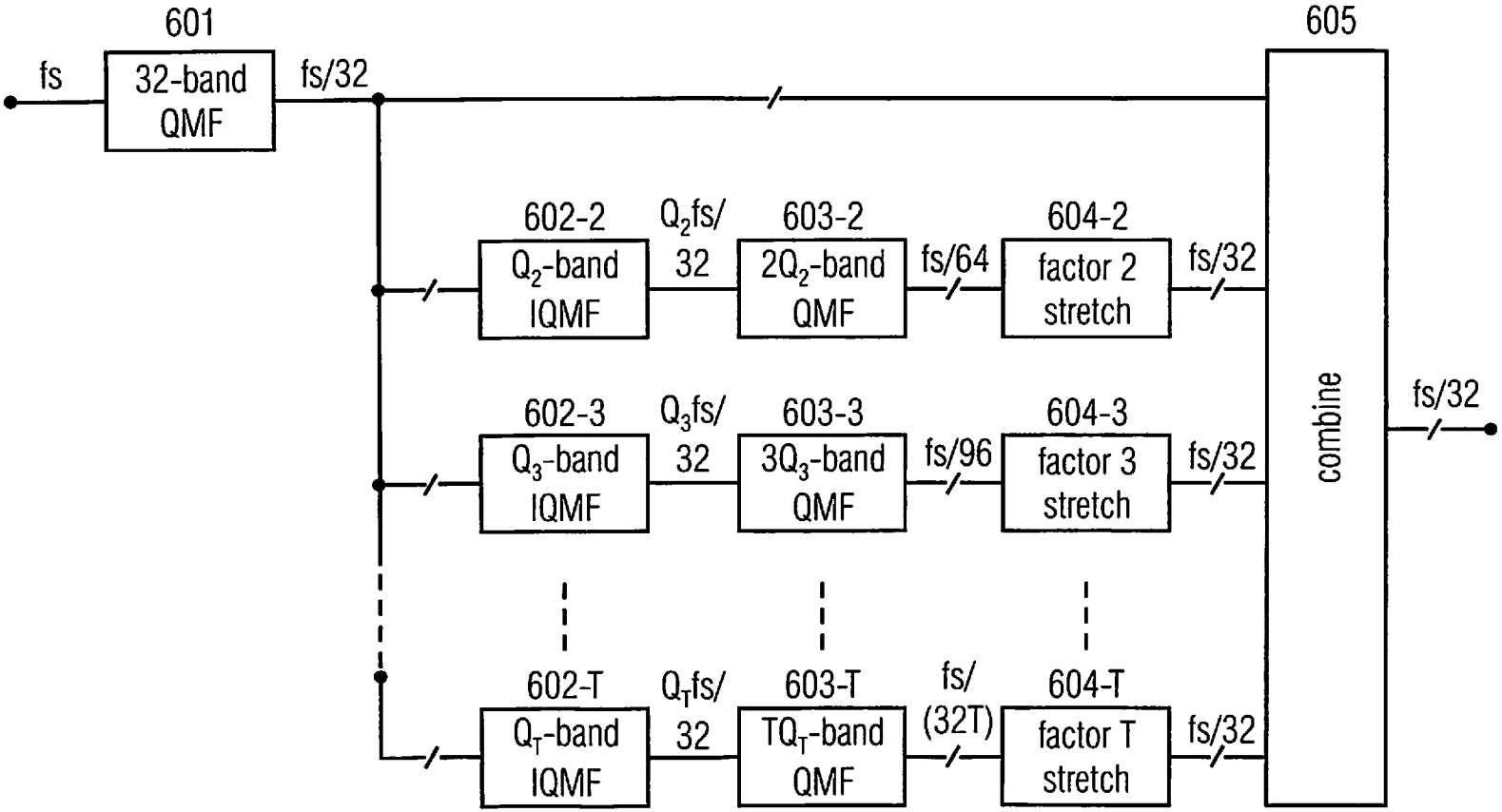
FIG. 6 illustrates an efficient implementation of the block based transposer of FIG. 1, where the resamplers and bandpass filters preceding the HFR analysis filter banks are replaced by small subsampled synthesis filter banks operating on selected subbands from a 32-band analysis filter bank.
Figure 7:
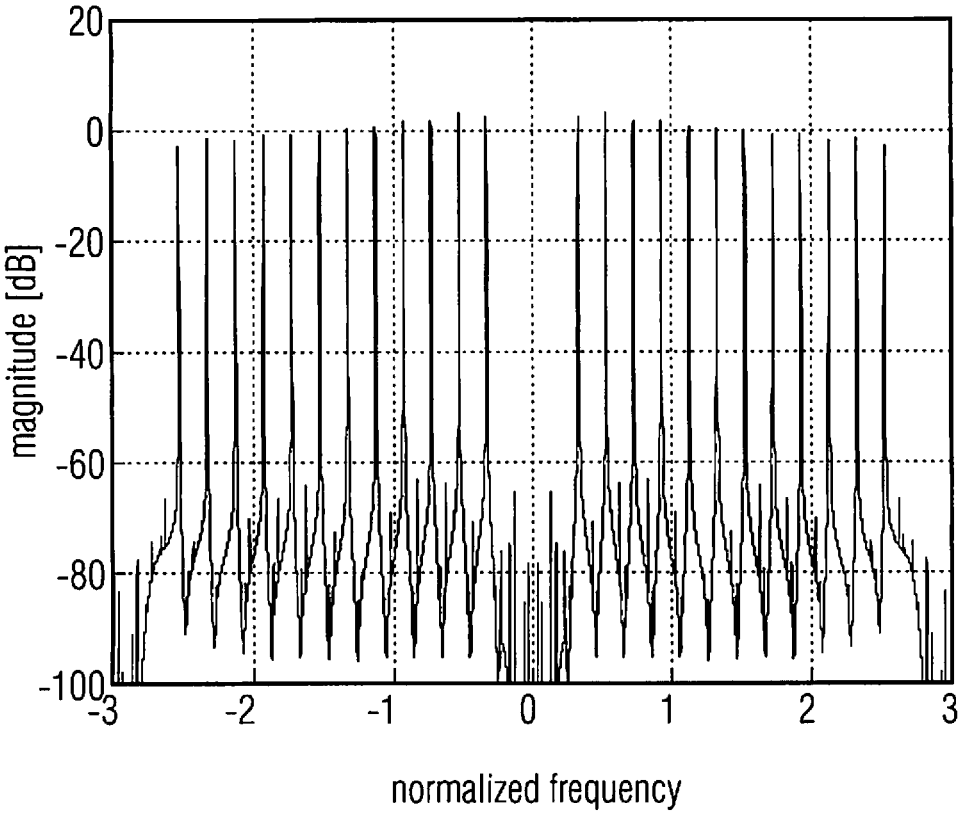
FIG. 7 illustrates the effect on an example signal processed by a subsampled synthesis filter bank of FIG. 6 for a transposition order of 2.
Figure 8A:
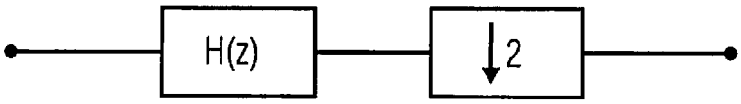
FIG. 8 illustrates the implementing blocks of an efficient multi-rate time domain downsampler of a factor 2.
Figure 8B:
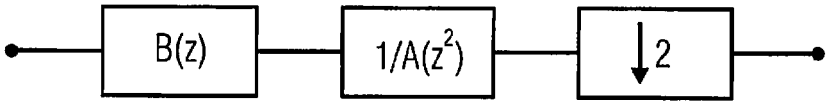
Figure 8C:
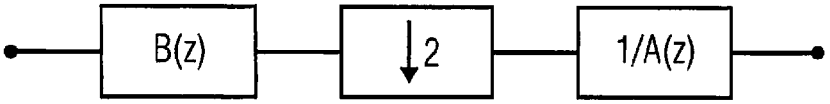
Figure 8D:
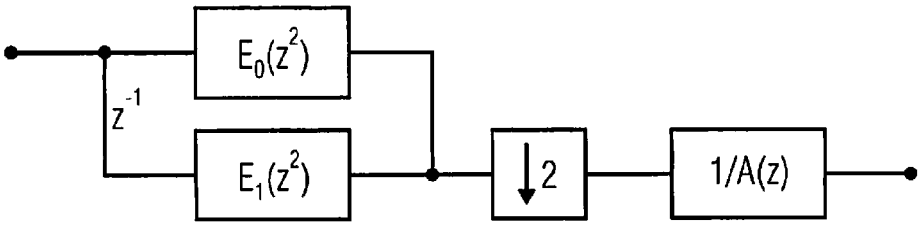
Figure 8E:
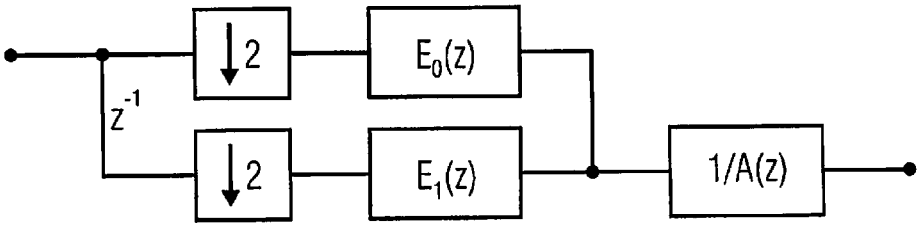
Figure 9A:
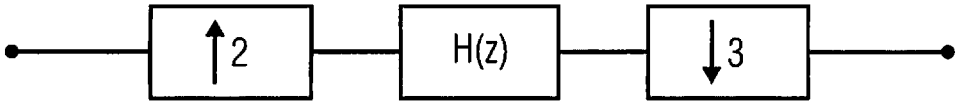
FIG. 9 illustrates the implementing blocks of an efficient multi-rate time domain downsampler of a factor 3/2.
Figure 9B:
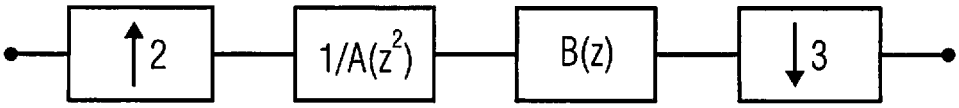
Figure 9C:
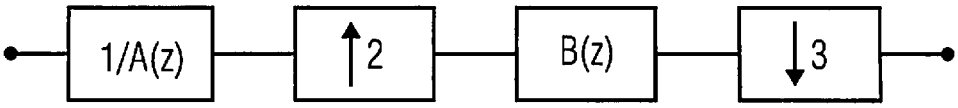
Figure 9D:
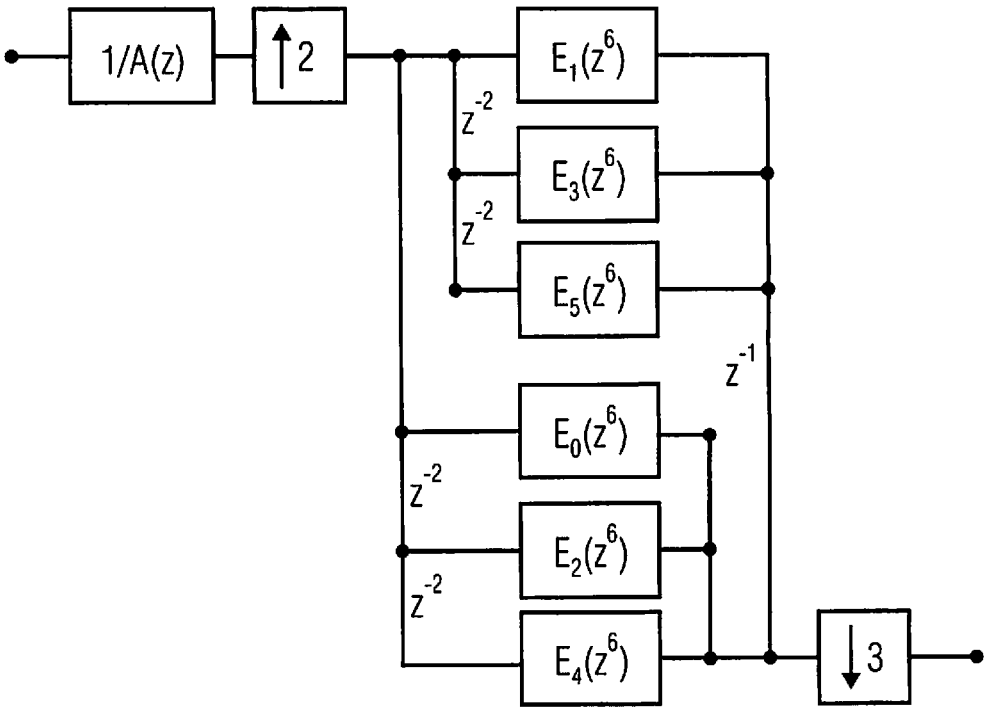
Figure 9E:
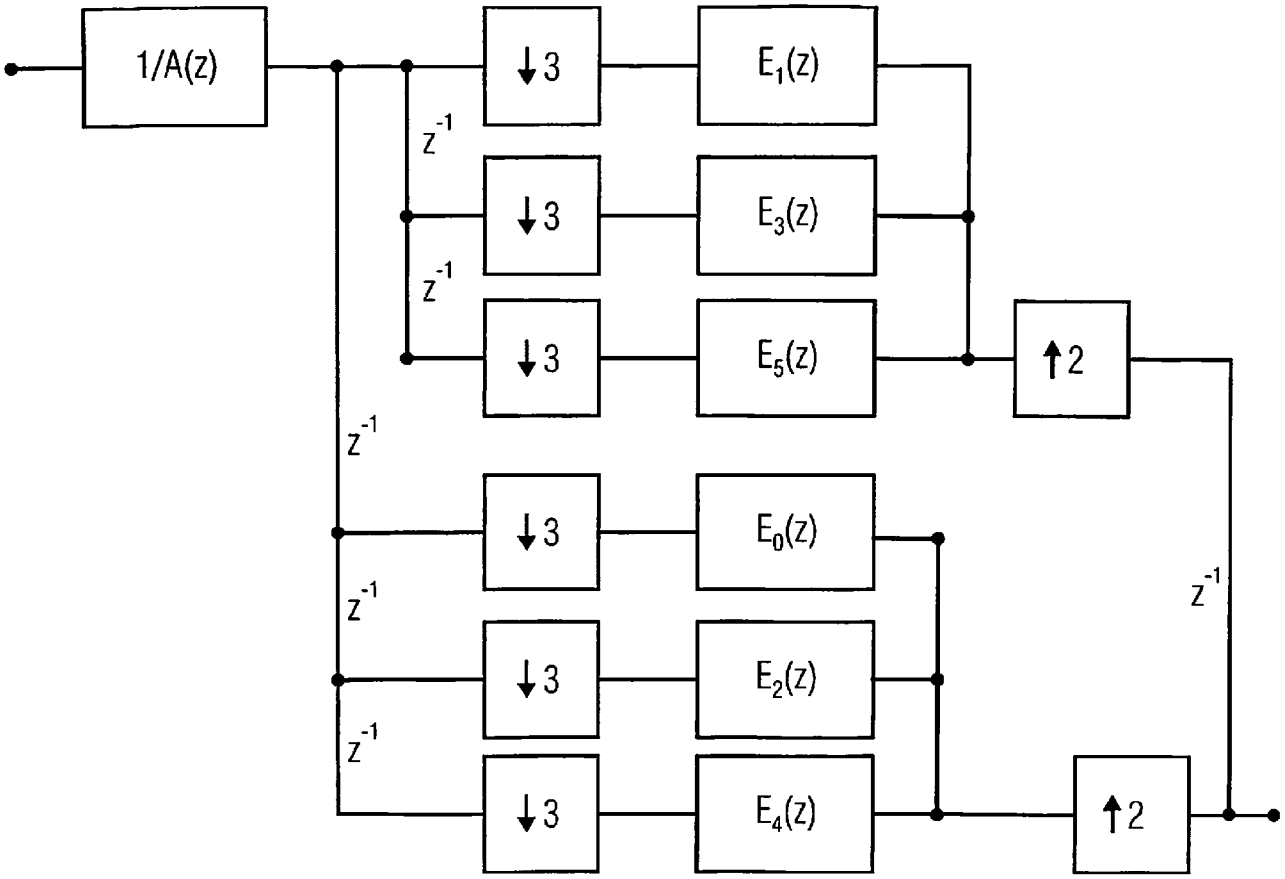

Another approach is to use the subband outputs from the subsampled 32-band analysis QMF bank 102 already present in the SBR HFR method. The subbands covering the source ranges for the different transposer branches are synthesized to the time domain by small subsampled QMF banks preceding the HFR analysis filter banks. This type of HFR system is illustrated in FIG. 6. The small QMF banks are obtained by subsampling the original 64-band QMF bank, where the prototype filter coefficients are found by linear interpolation of the original proto-type filter. Following the notations in FIG. 6, the synthesis QMF bank preceding the $2^{nd}$ order transposer branch has Q2=12 bands (the subbands with zero-based indices from 8 to 19 in the 32-band QMF). To prevent aliasing in the synthesis process, the first (index 8) and last (index 19) bands are set to zero. The resulting spectral output is shown in FIG. 7. Note that the block based transposer analysis filter bank has 2Q2=24 bands, i.e. the same number of bands as in the multi-rate time domain downsampler based example (FIG. 3).

The system outlined in FIG. 1 can be viewed as a simplified special case of the resampling outlined in FIGS. 3 and 4. In order to simplify the arrangement, the modulators are omitted. Further, all HFR analysis filtering are obtained using 64-band analysis filter banks. Hence, $P_2=P_3=P_4=64$ of FIG. 3, and the downsampling factors are 1, 1.5 and 2 for the $2^{nd}$, $3^{rd}$ and $4^{th}$ order transposer branches respectively.

A block diagram of a factor 2 downsampler is shown in FIG. 8(*a*). The now real-valued low pass filter can be written H(z)=B(z) I A(z), where B(z) is the non-recursive part (FIR) and A(z) is the recursive part (IIR). However, for an efficient implementation, using the Noble Identities to decrease computational complexity, it is beneficial to design a filter where all poles have multiplicity 2 (double poles) as $A(z^2)$ . Hence the filter can be factored as shown in FIG. 8(*b*). Using Noble Identity 1, the recursive part may be moved past the decimator as in FIG. 8(*c*). The non-recursive filter B(z) can be implemented using standard 2-component poly-phase decomposition as $$B(z) = \sum_{n=0}^{N_s} b(n)z^{-n} = \sum_{l=0}^{1} z^{-l}E_l(z^2), \text{ where } E_l(z) = \sum_{n=0}^{N_s/2} b(2\cdot n + l)z^{-n}$$

Hence, the downsampler may be structured as in FIG. 8(*d*). After using Noble Identity 1, the FIR part is computed at the lowest possible sampling rate as shown in FIG. 8(*e*). From FIG. 8(*e*) it is easy to see that the FIR operation (delay, decimators and polyphase components) can be viewed as a window-add operation using an input stride of two samples. For two input samples, one new output sample will be produced, effectively resulting in a downsampling of a factor 2.

A block diagram of the factor 1.5=3/2 downsampler is shown in FIG. 9(*a*). The real-valued low pass filter can again be written H(z)=B(z)/A(z), where B(z) is the non-recursive part (FIR) and A(z) is the recursive part (IIR). As before, for an efficient implementation, using the Noble Identities to decrease computational complexity, it is beneficial to design a filter where all poles either have multiplicity 2 (double poles) or multiplicity 3 (triple poles) as $A(z^2)$ or $A(z^3)$ respectively. Here, double poles are chosen as the design algorithm for the low pass filter is more efficient, although the recursive part actually gets 1.5 times more complex to implement compared to the triple pole approach. Hence the filter can be factored as shown in FIG. 9(*b*). Using Noble Identity 2, the recursive part may be moved in front of the interpolator as in FIG. 9(*c*). The non-recursive filter B(z) can be implemented using standard 2.3=6 component polyphase decomposition as $$B(z) = \sum_{n=0}^{N_s} b(n)z^{-n} = \sum_{l=0}^{5} z^{-l}E_l(z^6), \text{ where } E_l(z) = \sum_{n=0}^{N_s/6} b(6\cdot n + l)z^{-n}$$

Hence, the downsampler may be structured as in FIG. 9(*d*). After using both Noble Identity 1 and 2, the FIR part is computed at the lowest possible sampling rate as shown in FIG. 9(*e*). From FIG. 9(*e*) it is easy to see that the even-indexed output samples are computed using the lower group of three polyphase filters ($E_0(z)$, $E_2(z)$, $E_4(z)$) while the odd-indexed samples are computed from the higher group ($E_1(z)$, $E_3(z)$, $E_5(z)$). The operation of each group (delay chain, decimators and polyphase components) can be viewed as a window-add operation using an input stride of three samples. The window coefficients used in the upper group are the odd indexed coefficients, while the lower group uses the even index coefficients from the original filter B(z). Hence, for a group of three input samples, two new output samples will be produced, effectively resulting in a downsampling of a factor 1.5.

The time domain signal from the core decoder (101 in FIG. 1) may also be subsampled by using a smaller subsampled synthesis transform in the core decoder. The use of a smaller synthesis transform offers even further decreased computational complexity. Depending on the cross-over frequency, i.e. the bandwidth of the core coder signal, the ratio of the synthesis transform size and the nominal size Q (Q<1), results in a core coder output signal having a sampling rate$Qf_S$. To process the subsampled core coder signal in the examples outlined in the current application, all the analysis filter banks of FIG. 1 (102, 103-32, 103-33 and 103-34) need to scaled by the factor Q, as well as the downsamplers (301-2, 301-3 and 301-T) of FIG. 3, the decimator 404 of FIG. 4, and the analysis filter bank 601 of FIG. 6. Apparently, Q has to be chosen so that all filter bank sizes are integers.

Figures 10A, 10B, 10C:
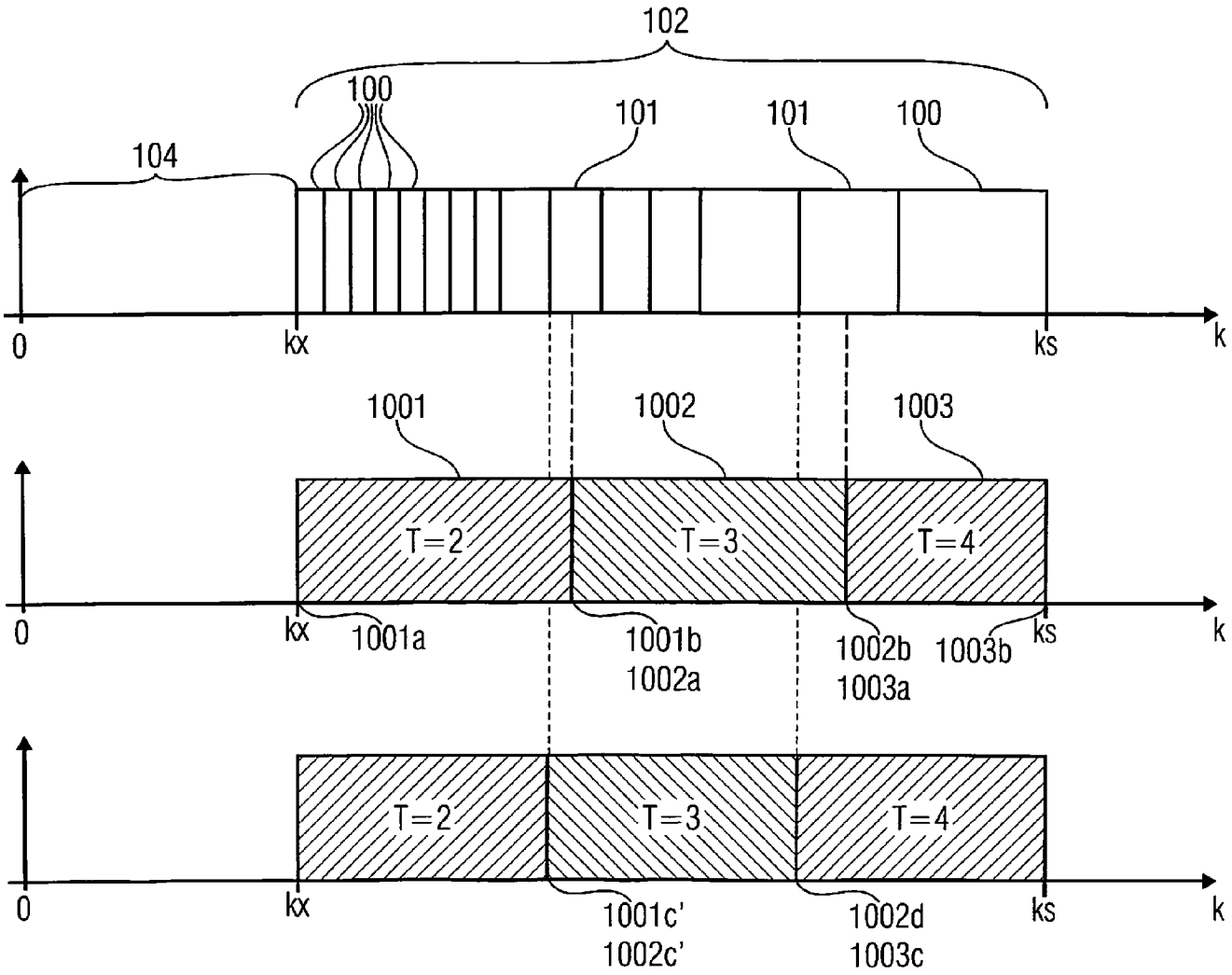
FIG. 10 illustrates the alignment of the spectral borders of the HFR transposer signals to the borders of the envelope adjustment frequency bands in a HFR enhanced coder.

FIG. 10 illustrates the alignment of the spectral borders of the HFR transposer signals to the spectral borders of the envelope adjustment frequency table in a HFR enhanced coder, such as SBR [ISO/IEC 14496-3:2009, "Information technology—Coding of audio-visual objects—Part 3: Audio]. FIG. 10(*a*) shows a stylistic graph of the frequency bands comprising the envelope adjustment table, the so-called scale-factor bands, covering the frequency range from the cross-over frequency $k_x$ to the stop frequency $k_s$. The scale-factor bands constitute the frequency grid used in a HFR enhanced coder when adjusting the energy level of the regenerated high-band over frequency, i.e. the frequency envelope. In order to adjust the envelope, the signal energy is averaged over a time/frequency block constrained by the scale-factor band borders and selected time borders.

Specifically, FIG. 10 illustrates in the upper portion, a division into frequency bands 100, and it becomes clear from FIG. 10 that the frequency bands increase with frequency, where the horizontal axis corresponds to the frequency and has in the notation in FIG. 10, filterbank channels k, where the filterbank can be implemented as a QMF filterbank such as a 64 channel filterbank or can be implemented via a digital Fourier transform, where k corresponds to a certain frequency bin of the DFT application. Hence, a frequency bin of a DFT application and a filterbank channel of a QMF application indicate the same in the context of this description. Hence, the parametric data are given for the high frequency part 102 in frequency bins 100 or frequency bands. The low frequency part of the finally bandwidth extended signal is indicated at 104. The intermediate illustration in FIG. 10 illustrates the patch ranges for a first patch 1001, a second patch 1002 and a third patch 1003. Each patch extends between two patch borders, where there is a lower patch border 1001*a* and a higher patch border 1001*b* for the first patch. The higher border of the first patch indicated at 1001*b* corresponds to the lower border of the second patch which is indicated at 1002*a*. Hence, reference numbers 1001*b* and 1002*a* actually refer to one and the same frequency. A higher patch border 1002*b* of the second patch again corresponds to a lower patch border 1003*a* of the third patch, and the third patch also has a high patch border 1003*b*. It is advantageous that no holes exist between individual patches, but this is not an ultimate requirement. It is visible in FIG. 10 that the patch borders 1001*b*, 1002*b* do not coincide with corresponding borders of the frequency bands 100, but are within certain frequency bands 101. The lower line in FIG. 10 illustrates different patches with aligned borders 1001*c*, where the alignment of the upper border 1001*c* of the first patch automatically means the alignment of the lower border 1002*c* of the second patch and vice versa. Additionally, it is indicated that the upper border of the second patch 1002*d* is now aligned with the lower frequency border of frequency band 101 in the first line of FIG. 10 and that, therefore, automatically the lower border of the third patch indicated at 1003*c* is aligned as well.

In the FIG. 10 embodiment, it is shown that the aligned borders are aligned to the lower frequency border of the matching frequency band 101, but the alignment could also be done in a different direction, i.e. that the patch border 1001*c*, 1002*c* is aligned to the upper frequency border of band 101 rather than to the lower frequency border thereof. Depending on the actual implementation, one of those possibilities can be applied and there can even be a mix of both possibilities for different patches.

If the signals generated by different transposition orders are unaligned to the scale-factor bands, as illustrated in FIG. 10(*b*), artifacts may arise if the spectral energy drastically changes in the vicinity of a transposition band border, since the envelope adjustment process will maintain the spectral structure within one scale-factor band. Hence, the invention adapts the frequency borders of the transposed signals to the borders of the scale-factor bands as shown in FIG. 10(*c*). In the figure, the upper border of the signals generated by transposition orders of 2 and 3 (T=2, 3) are lowered a small amount, compared to FIG. 10(*b*), in order to align the frequency borders of the transposition bands to existing scale-factor band borders.

Figures 11A, 11B, 11C:
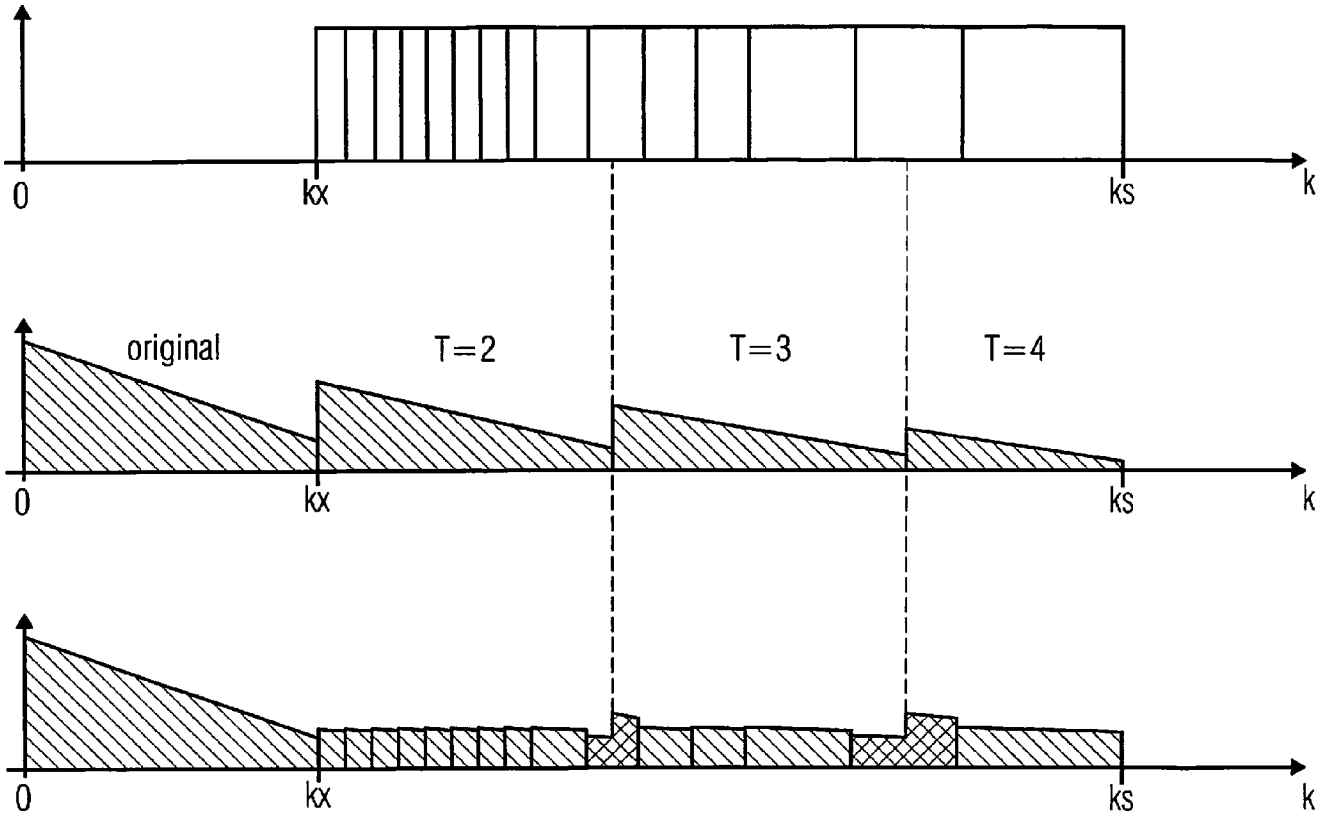
FIG. 11 illustrates a scenario where artifacts emerge due to unaligned spectral borders of the HFR transposer signals.

A realistic scenario showing the potential artifacts when using unaligned borders is depicted in FIG. 11. FIG. 11(*a*) again shows the scale-factor band borders. FIG. 11(*b*) shows the unadjusted HFR generated signals of transposition orders T=2, 3 and 4 together with the core decoded base band signal. FIG. 11(*c*) shows the envelope adjusted signal when a flat target envelope is assumed. The blocks with checkered areas represent scale-factor bands with high intraband energy variations, which may cause anomalies in the output signal.

Figures 12A, 12B, 12C:
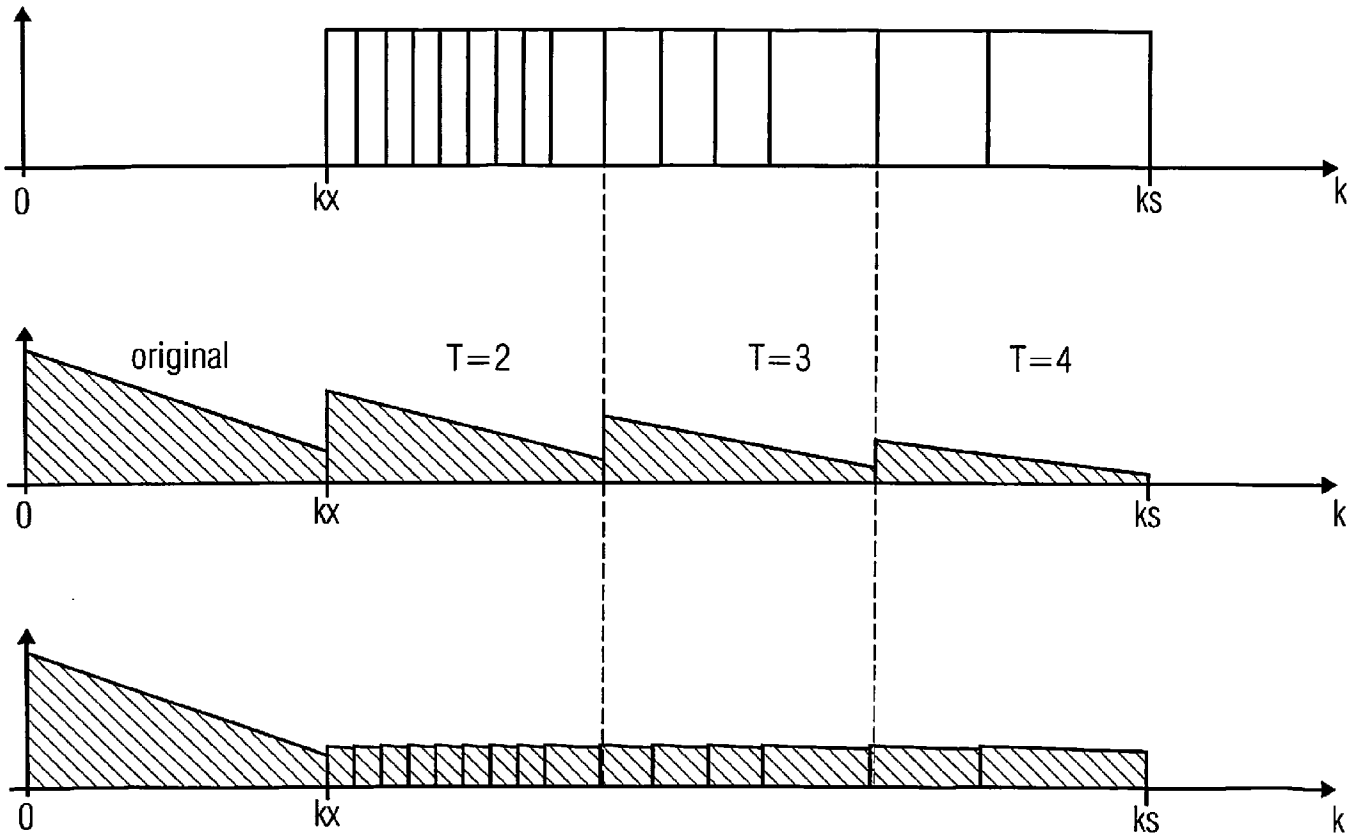
FIG. 12 illustrates a scenario where the artifacts of FIG. 11 are avoided as a result of aligned spectral borders of the HFR transposer signals.

FIG. 12 illustrates the scenario of FIG. 11, but this time using aligned borders. FIG. 12(*a*) shows the scale-factor band borders, FIG. 12(*b*) depicts the unadjusted HFR generated signals of transposition orders T=2, 3 and 4 together with the core decoded base band signal and, in line with FIG. 11(*c*), FIG. 12(*c*) shows the envelope adjusted signal when a flat target envelope is assumed. As seen from this figure, there are no scale-factor bands with high intra-band energy variations due to misalignment of the transposed signal bands and the scale-factor bands, and hence the potential artifacts are diminished.

Figure 25A:
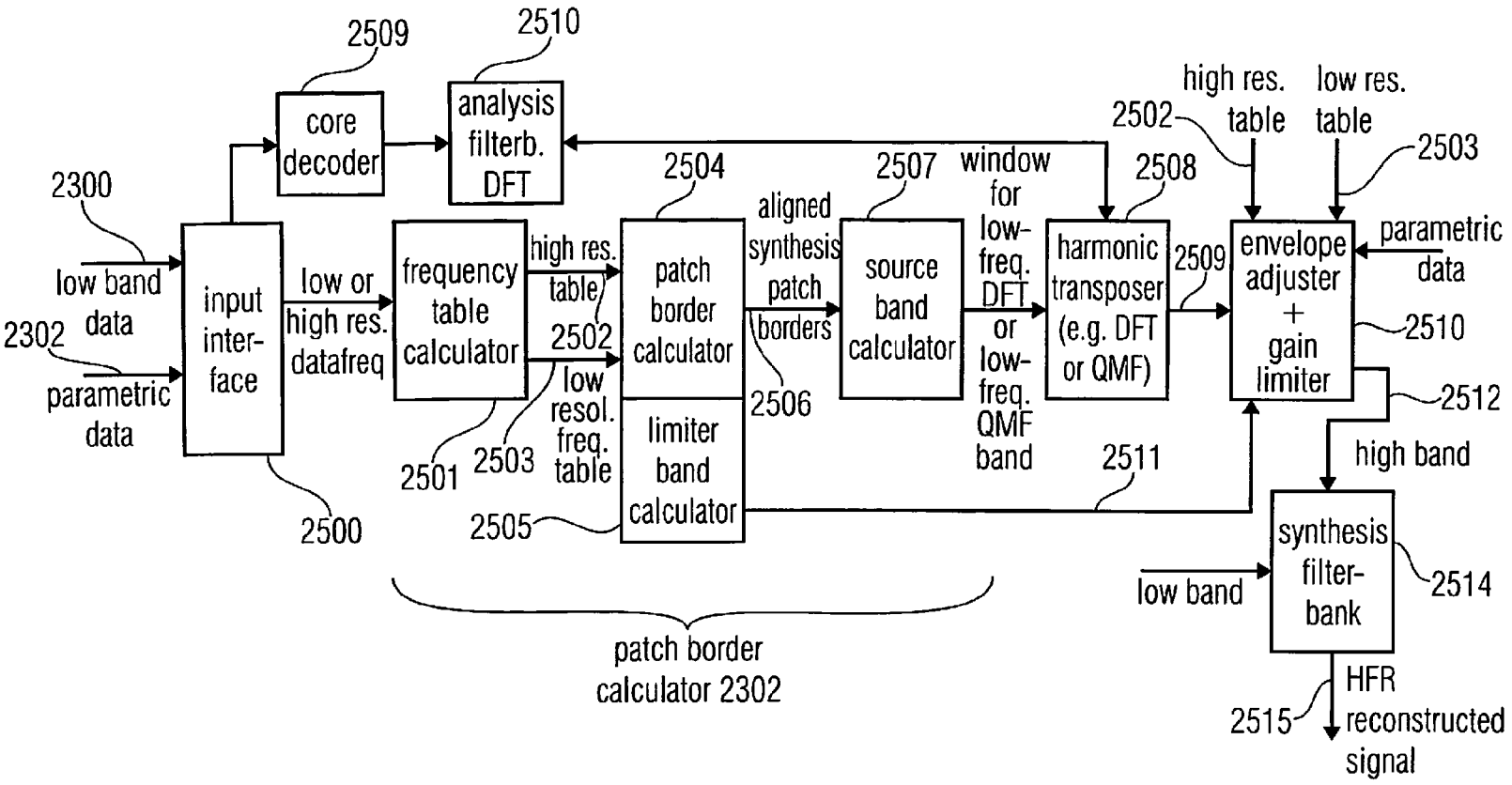
FIG. 25*a* illustrates a block diagram illustrating more details of the patch border calculator and more details on the spectral envelope adjustment in the context of the alignment of patch borders.

FIG. 25*a* illustrates an overview of an implementation of the patch border calculator 2302 and the patcher and the location of those elements within a bandwidth extension scenario in accordance with an embodiment. Specifically, an input interface 2500 is provided, which receives the low band data 2300 and parametric data 2302. The parametric data can be bandwidth extension data as, for example, known from ISO/IEC 14496-3: 2009, which is incorporated herein by reference in its entirety, and particularly with respect to the section related to bandwidth extension, which is section 4.6.18 "SBR tool". Of particular relevance in section 4.6.18 is section 4.6.18.3.2 "Frequency band tables", and particularly the calculation of some frequency tables $f_{master}$, $f_{TableHigh}$, $f_{TableLow}$, $f_{TableNoise}$ and $f_{TableLim}$. Particularly, section 4.6.18.3.2.1 of the Standard defines the calculation of the master frequency band tables, and section 4.6.18.3.2.2 defines the calculation of the derived frequency band tables from the master frequency band table, and particularly outputs how $f_{TableHigh}$, $f_{TableLow}$ and $f_{TableNoise}$ are calculated. Section 4.6.18.3.2.3 defines the calculation of the limiter frequency band table.

The low resolution frequency table $f_{TableLow}$ is for low resolution parametric data and the high resolution frequency table $f_{TableHigh}$ is for high resolution parametric data, which are both possible in the context of the MPEG-4 SBR tool, as discussed in the mentioned Standard and whether the parametric data is low resolution parametric data or high resolution parametric data depends on the encoder implementation. The input interface 2500 determines whether the parametric data is low or high resolution data and provides this information to the frequency table calculator 2501. The frequency table calculator then calculates the master table or generally derives a high resolution table 2502 and a low resolution table 2503 and provides same to the patch border calculator core 2504, which additionally comprises or cooperates with a limiter band calculator 2505. Elements 2504 and 2505 generate aligned synthesis patch borders 2506 and corresponding limiter band borders related to the synthesis range. This information 2506 is provided to a source band calculator 2507, which calculates the source range of the low band audio signal for a certain patch so that together with the corresponding transposition factors, the aligned synthesis patch borders 2506 are obtained after patching using, for example, a harmonic transposer 2508 as a patcher.

Particularly, the harmonic transposer 2508 may perform different patching algorithms such as a DFT-based patching algorithm or a QMF-based patching algorithm. The harmonic transposer 2508 may be implemented to perform a vocoder-like processing which is described in the context of FIGS. 26 and 27 for the QMF-based harmonic transposer embodiment, but other transposer operations such as a DFT-based transposer for the purpose of generating a high frequency portion in a vocoder-like structure can be used as well. For the DFT-based transposer, the source band calculator calculates frequency windows for the low frequency range. For the QMF-based implementation, the source band calculator 2507 calculates the useful QMF bands of the source range for each patch. The source range is defined by the low band audio data 2300, which is typically provided in an encoded form and is forwarded by the input interface 2500 to a core decoder 2509. The core decoder 2509 feeds its output data into an analysis filterbank 2510, which can be a QMF implementation or a DFT implementation. In the QMF implementation, the analysis filterbank 2510 may have 32 filterbank channels, and these 32 filterbank channels define the "maximum" source range, and the harmonic transposer 2508 then selects, from these 32 bands, the actual bands making up the adjusted source range as defined by the source band calculator 2507 in order to, for example, fulfill the adjusted source range data in the table of FIG. 23, provided that the frequency values in the table in FIG. 23 are converted to synthesis filterbank subband indices. A similar procedure can be performed for the DFT-based transposer, which receives for each patch a certain window for the low frequency range and this window is then forwarded to the DFT block 2510 to select the source range in accordance with the adjusted or aligned synthesis patch borders calculated by block 2504.

The transposed signal 2509 output by the transposer 2508 is forwarded to an envelope adjuster and gain limiter 2510, which receives as an input the high resolution table 2502 and the low resolution table 2503, the adjusted limiter bands 2511 and, naturally, the parametric data 2302. The envelope adjusted high band on line 2512 is then input into a synthesis filterbank 2514, which additionally receives the low band typically in the form as output by the core decoder 2509. Both contributions are merged by the synthesis filterbank 2514 to finally obtain the high frequency reconstructed signal on line 2515.

It is clear that the merging of the high band and the low band can be done differently, such as by performing a merging in the time domain rather than in the frequency domain. Furthermore, it is clear that the order of merging irrespective of the implementation of the merging and envelope adjustment can be changed, i.e. so that envelope adjustment of a certain frequency range can be performed subsequent to merging or, alternatively, before merging, where the latter case is illustrated in FIG. 25*a*. It is furthermore outlined that envelope adjustment can even be performed before the transposition in the transposer 2508, so that the order of the transposer 2508 and the envelope adjuster 2510 can also be different from what is illustrated in FIG. 25*a* as one embodiment.

As already outlined in the context of block 2508, a DFT-based harmonic transposer or a QMF-based harmonic transposer can be applied in embodiments. Both algorithms rely on a phase-vocoder frequency spreading. The core coder time-domain signal is bandwidth extended using a modified phase vocoder structure. The bandwidth extension is performed by time stretching followed by decimation, i.e. transposition, using several transposition factors (t=2, 3, 4) in a common analysis/synthesis transform stage. The output signal of the transposer will have a sampling rate twice that of the input signal, which means that for a transposition factor of two, the signal will be time stretched but not decimated, efficiently producing a signal of equal time duration as the input signal but having the twice the sampling frequency. The combined system may be interpreted as three parallel transposers using transposition factors of 2, 3 and 4, respectively, where the decimation factors are 1, 1.5 and 2. To reduce complexity, the factor 3 and 4 transposers (third and fourth order transposers) are integrated into the factor 2 transposer (second order transposer) by means of interpolation as is subsequently discussed in the context of FIG. 27.

For each frame, a nominal "full size" transform size of a transposer is determined depending on a signal-adaptive frequency domain oversampling which can be applied in order to improve the transient response or which can be switched off. This value is indicated in FIG. 24*a* as FFTSizeSyn. Then, blocks of windowed input samples are transformed, where for the block extraction a block advance value or analysis stride value of a much smaller number of samples is performed in order to have a significant overlap of blocks. The extracted blocks are transformed to the frequency domain by means of a DFT depending on the signal-adaptive frequency domain oversampling control signal. The phases of the complex-valued DFT coefficients are modified according to the three transposition factors used. For the second order transposition, the phases are doubled, for the third and fourth order transpositions the phases are tripled, quadrupled or interpolated from two consecutive DFT coefficients. The modified coefficients are subsequently transformed back to the time domain by means of a DFT, windowed and combined by means of overlap-add using an output stride different from the input stride. Then, using the algorithm illustrated in FIG. 24*a*, the patch borders are calculated and written into the array xOverBin. Then, the patch borders are used for calculating time domain transform windows for the application of the DFT transposer. For the QMF transposer source range channel numbers are calculated based on the patch borders calculated in the synthesis range. Advantageously, this is actually happening before the transposition as this is needed as control information for generating the transposed spectrum.

Figure 24B:
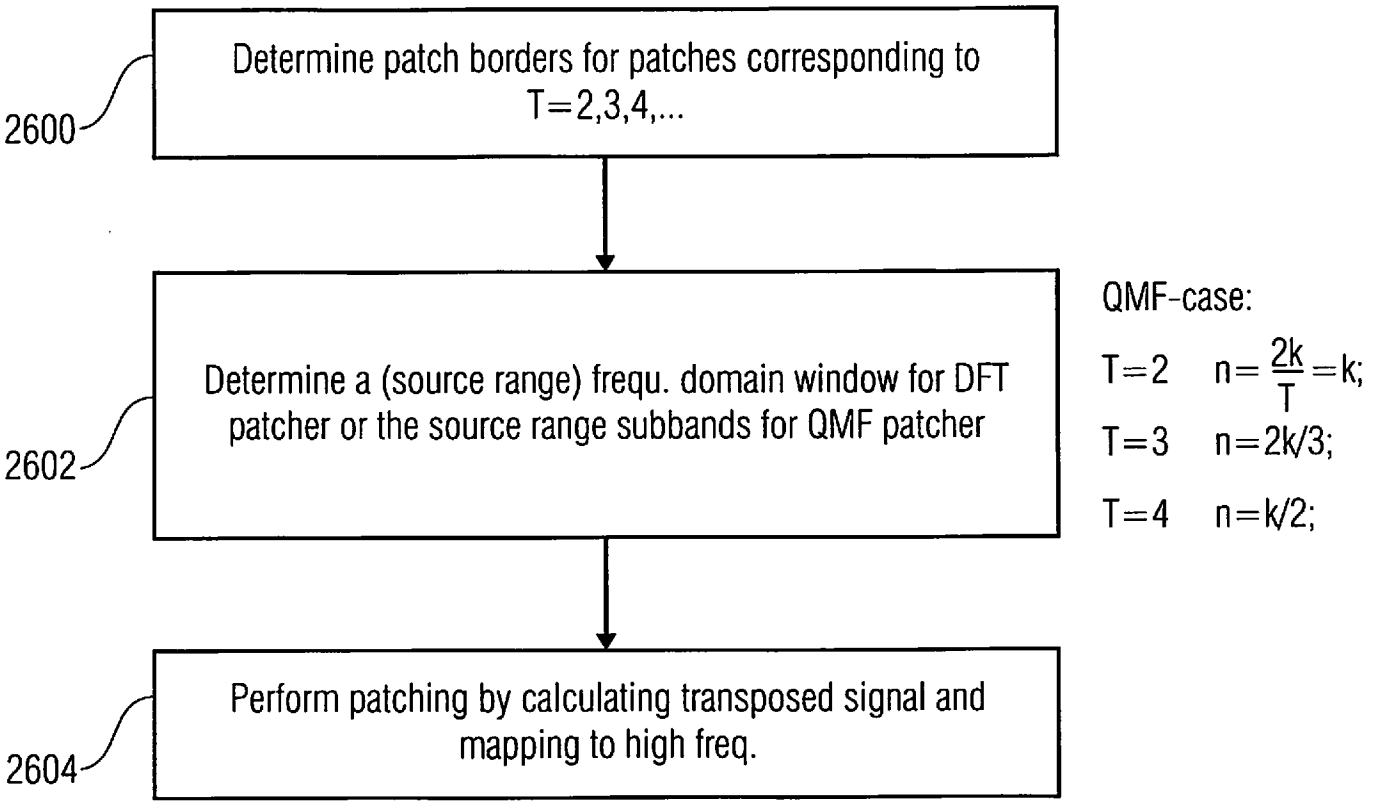
FIG. 24*b* illustrates a further overview of a sequence of steps performed by embodiments of the invention.
Figure 25B:
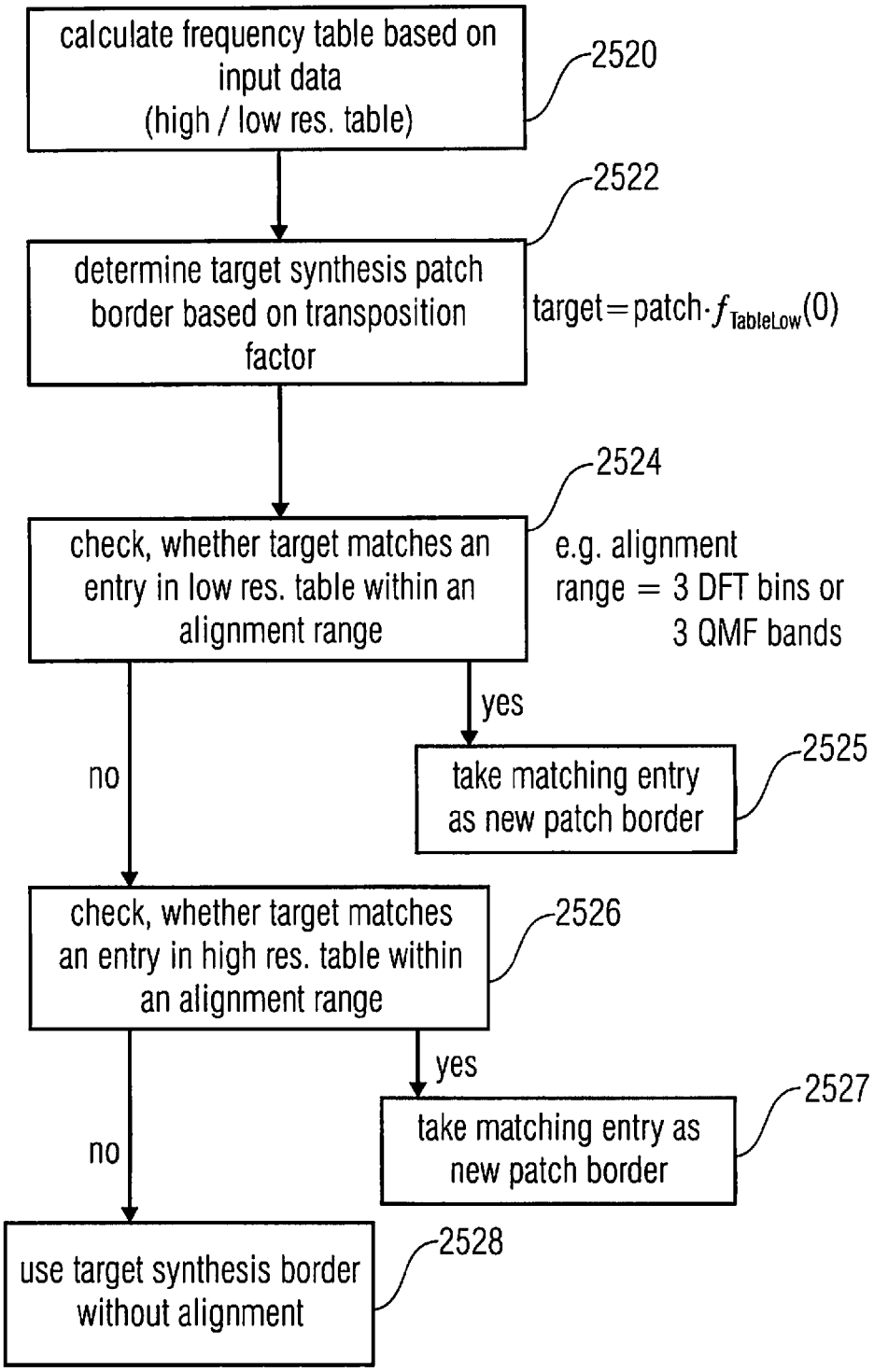
FIG. 25*b* illustrates a flowchart for the procedure indicated in FIG. 24*a* as a pseudo code.

Subsequently, the pseudo code indicated in FIG. 24*a* is discussed in connection with the flowchart in FIG. 25*b* illustrating one advantageous implementation of the patch border calculator. In step 2520, a frequency table is calculated based on the input data such as a high or low resolution table. Hence, block 2520 corresponds to block 2501 of FIG. 25*a*. Then, in step 2522 a target synthesis patch border is determined based on the transposition factor. Particularly, the target synthesis patch border corresponds to the result of the multiplication of the patch value of FIG. 24*a* and $f_{TableLow}(0)$, where $f_{TableLow}(0)$ indicates the first channel or bin of the bandwidth extension range, i.e. the first band above the crossover frequency, below which the input audio data 2300 is given with high resolution. In step 2524, it is checked whether the target synthesis patch border matches an entry in the low resolution table within an alignment range. Particularly, an alignment range of 3 is advantageous as, for example, indicated at 2525 in FIG. 24*a*. However, other ranges are useful as well, such as ranges smaller than or equal to 5. When it is determined in step 2524 that the target matches an entry in the low resolution table, then this matching entry is taken as the new patch border instead of the target patch border. However, when it is determined that no entry exists within the alignment range, step 2526 is applied, in which the same examination is done with the high resolution table as also indicated in 2527 in FIG. 24*a*. When it is determined in step 2526 that a table entry within the alignment range does exist, then the matching entry is taken as a new patch border instead of the target synthesis patch border. However, when it is determined in step 2526 that even in the high resolution table no value exists within the alignment range, then step 2528 is applied, in which the target synthesis border is used without any alignment. This is also indicated in FIG. 24*a* at 2529. Hence, step 2528 can be seen as a fallback position so that it is guaranteed in any case that the bandwidth extension decoder does not remain in a loop, but comes to a solution in any case even when there is a very specific and problematic selection of the frequency tables and the target ranges.

Regarding the pseudo code in FIG. 24*a*, it is outlined that the code lines at 2531 perform a certain preprocessing in order to make sure that all the variables are in a useful range. Furthermore, the check whether the target matches an entry in the low resolution table within an alignment range is performed as the calculation of a difference (lines 2525, 2527) between the target synthesis patch border calculated by the product indicated near block 2522 in FIG. 25*b* and indicated in lines 2525, 2527 and an actual table entry defined by parameter sfbL for line 2525 or sfbH for line 2527 (sfb=scale factor band). Naturally, other checking operations can be performed as well.

Furthermore, it is not necessarily the case that a matching within an alignment range is looked for where the alignment range is predetermined. Instead, a search in the table can be performed to find the best matching table entry, i.e. the table entry which is closest to the target frequency value irrespective of whether the difference between those two is small or high.

Other implementations relate to a search in the table, such as $f_{TableLow}$ or $f_{TableHigh}$ for the highest border that does not exceed the (fundamental) bandwidth limits of the HFR generated signal for a transposition factor T. Then, this found highest border is used as the frequency limit of the HFR generated signal of transposition factor T. In this implementation, the target calculation indicated near box 2522 in FIG. 25*b* is not required.

Figures 13A, 13B, 13C:
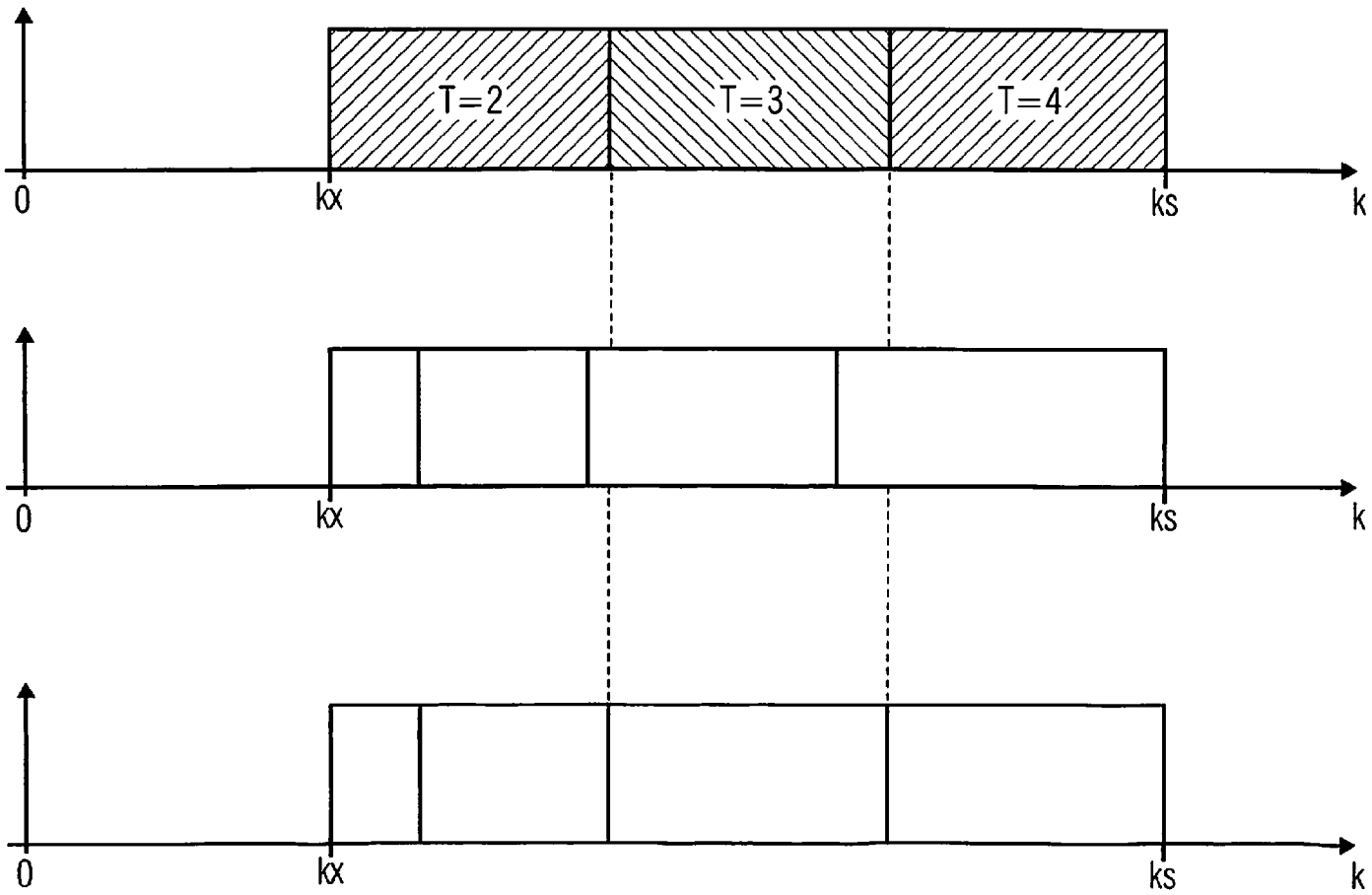
FIG. 13 illustrates the adaption of spectral borders in the limiter tool to the spectral borders of the HFR transposer signals.

FIG. 13 illustrates the adaption of the HFR limiter band borders, as described in e.g. SBR [ISO/IEC 14496-3:2009, "Information technology—Coding of audio-visual objects—Part 3: Audio] to the harmonic patches in a HFR enhanced coder. The limiter operates on frequency bands having a much coarser resolution than the scale-factor bands, but the principle of operation is very much the same. In the limiter, an average gain-value for each of the limiter bands is calculated. The individual gain values, i.e. the envelope gain values calculated for each of the scale-factor bands, are not allowed to exceed the limiter average gain value by more than a certain multiplicative factor. The objective of the limiter is to suppress large variations of the scale-factor band gains within each of the limiter bands. While the adaption of the transposer generated bands to the scale-factor bands ensures small variations of the intra-band energy within a scale-factor band, the adaption of the limiter band borders to the transposer band borders, according to the present invention, handles the larger scale energy differences between the transposer processed bands. FIG. 13(*a*) shows the frequency limits of the HFR generated signals of transposition orders T=2, 3 and 4. The energy levels of the different transposed signals can be substantially different. FIG. 13(*b*) shows the frequency bands of the limiter which typically are of constant width on a logarithmic frequency scale. The transposer frequency band borders are added as constant limiter borders and the remaining limiter borders are re-calculated to maintain the logarithmic relations as close as possible, as for example illustrated in FIG. 13(*c*).

Figure 21:
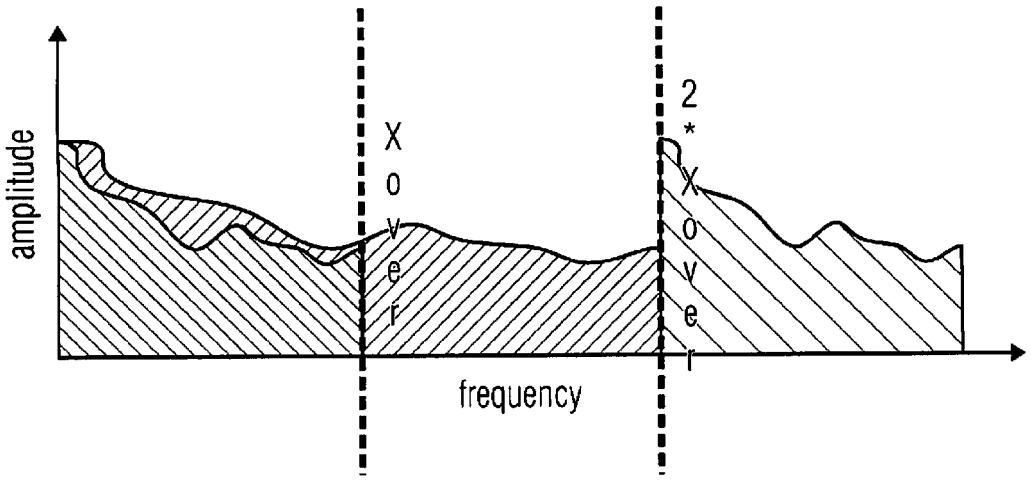
FIG. 21 illustrates a mixed patching, where the first patching is generated by frequency spreading and the second patch is generated by an SSB copy-up of a low-frequency portion.
Figure 22:
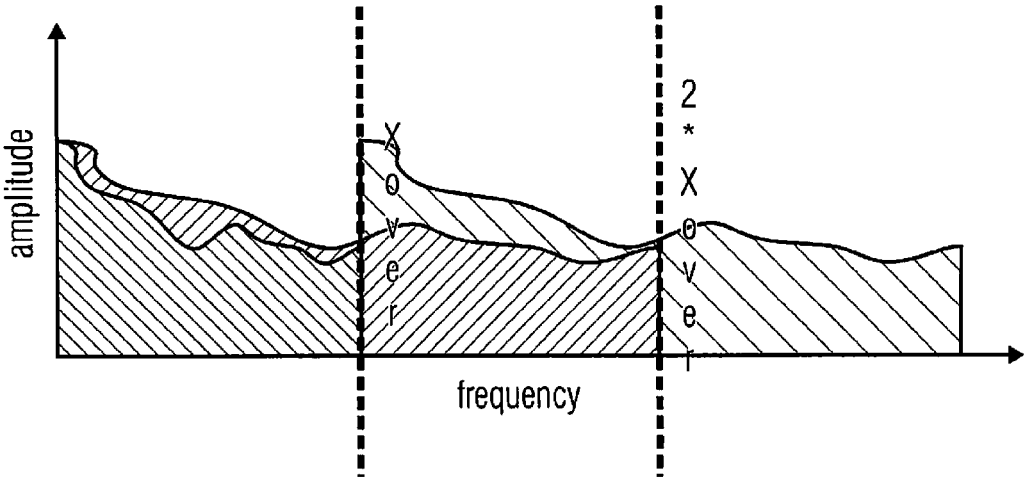
FIG. 22 illustrates an alternative mixed patching utilizing the first HBE patch for an SSB copy-up operation to generate a second patch.

Further embodiments employ a mixed patching scheme which is shown in FIG. 21, where the mixed patching method within a time block is performed. For full coverage of the different regions of the HF spectrum, a BWE comprises several patches. In HBE, the higher patches may use high transposition factors within the phase vocoders, which particularly deteriorate the perceptual quality of transients.

Thus embodiments generate the patches of higher order that occupy the upper spectral regions advantageously by computationally efficient SSB copy-up patching and the lower order patches covering the middle spectral regions, for which the preservation of the harmonic structure is desired, advantageously by HBE patching. The individual mix of patching methods can be static over time or, advantageously, be signaled in the bitstream.

For the copy-up operation, the low frequency information can be used as shown in FIG. 21. Alternatively, the data from patches that were generated using HBE methods can be used as illustrated in FIG. 21. The latter leads to a less dense tonal structure for higher patches. Besides these two examples, every combination of copy-up and HBE is conceivable.

The advantages of the proposed concepts are

Improved perceptual quality of transients

Reduced computational complexity

Figure 26:
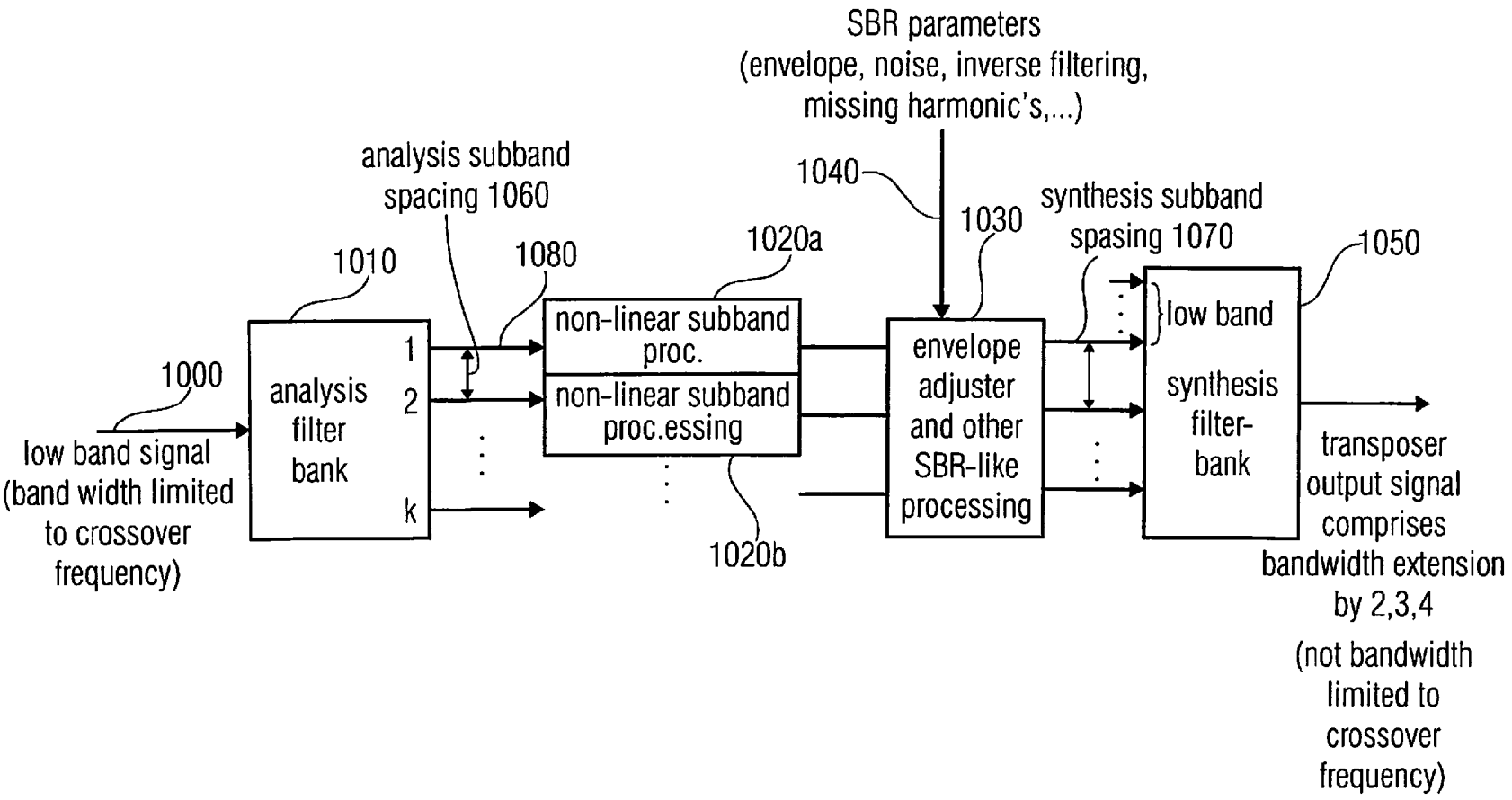
FIG. 26 illustrates an overview of the framework in the context of bandwidth extension processing.

FIG. 26 illustrates an advantageous processing chain for the purpose of bandwidth extension, where different processing operations can be performed within the non-linear subband processing indicated at blocks 1020*a*, 1020*b*. In an implementation, the band-selective processing of the processed time domain signal such as the bandwidth extended signal is performed in the time domain rather than in the subband domain, which exists before the synthesis filterbank 2311.

FIG. 26 illustrates an apparatus for generating a bandwidth extended audio signal from a low-band input signal 1000 in accordance with a further embodiment. The apparatus comprises an analysis filterbank 1010, a subband-wise non-linear subband processor 1020*a*, 1020*b*, a sub-sequently connected envelope adjuster 1030 or, generally stated, a high frequency reconstruction processor operating on high frequency reconstruction parameters as, for example, input at parameter line 1040. The envelope adjuster, or as generally stated, the high frequency reconstruction processor processes individual subband signals for each subband channel and inputs the processed subband signals for each subband channel into a synthesis filterbank 1050. The synthesis filterbank 1050 receives, at its lower channel input signals, a subband representation of the lowband core decoder signal. Depending on the implementation, the lowband can also be derived from the outputs of the analysis filterbank 1010 in FIG. 26. The transposed subband signals are fed into higher filterbank channels of the synthesis filterbank for performing high frequency reconstruction.

The filterbank 1050 finally outputs a transposer output signal which comprises bandwidth extensions by transposition factors 2, 3, and 4, and the signal output by block 1050 is no longer bandwidth-limited to the crossover frequency, i.e. to the highest frequency of the core coder signal corresponding to the lowest frequency of the SBR or HFR generated signal components. The analysis filterbank 1010 in FIG. 26 corresponds to the analysis filterbank 2510 and the synthesis filterbank 1050 may correspond to the synthesis filterbank 2514 in FIG. 25*a*. Particularly, as discussed in the context of FIG. 27, the source band calculation illustrated at block 2507 in FIG. 25*a* is performed within a non-linear subband processing 1020*a*, 1020*b*, using the aligned synthesis patch borders and limiter band borders calculated by blocks 2504 and 2505.

Regarding the limiter frequency band tables, it is to be noted that the limiter frequency band tables can be constructed to have either one limiter band over the entire reconstruction range or approximately 1.2, 2 or 3 bands per octave, signaled by a bitstream element bs_limiter bands as defined in ISO/IEC 14496-3: 2009, 4.6.18.3.2.3. The band table may comprise additional bands corresponding to the high frequency generator patches. The table may hold indices of the synthesis filterbank subbands, where the number of element is equal to the number of bands plus one. When harmonic transposition is active, it is made sure that the limiter band calculator introduces limiter band borders coinciding with the patch borders defined by the patch border calculator 2504. Additionally, the remaining limiter band borders are then calculated between those "fixedly" set limiter band borders for the patch borders.

In the FIG. 26 embodiment, the analysis filterbank performs a two times over sampling and has a certain analysis subband spacing 1060. The synthesis filterbank 1050 has a synthesis subband spacing 1070 which is, in this embodiment, double the size of the analysis subband spacing which results in a transposition contribution as will be discussed later in the context of FIG. 27.

Figure 27A:
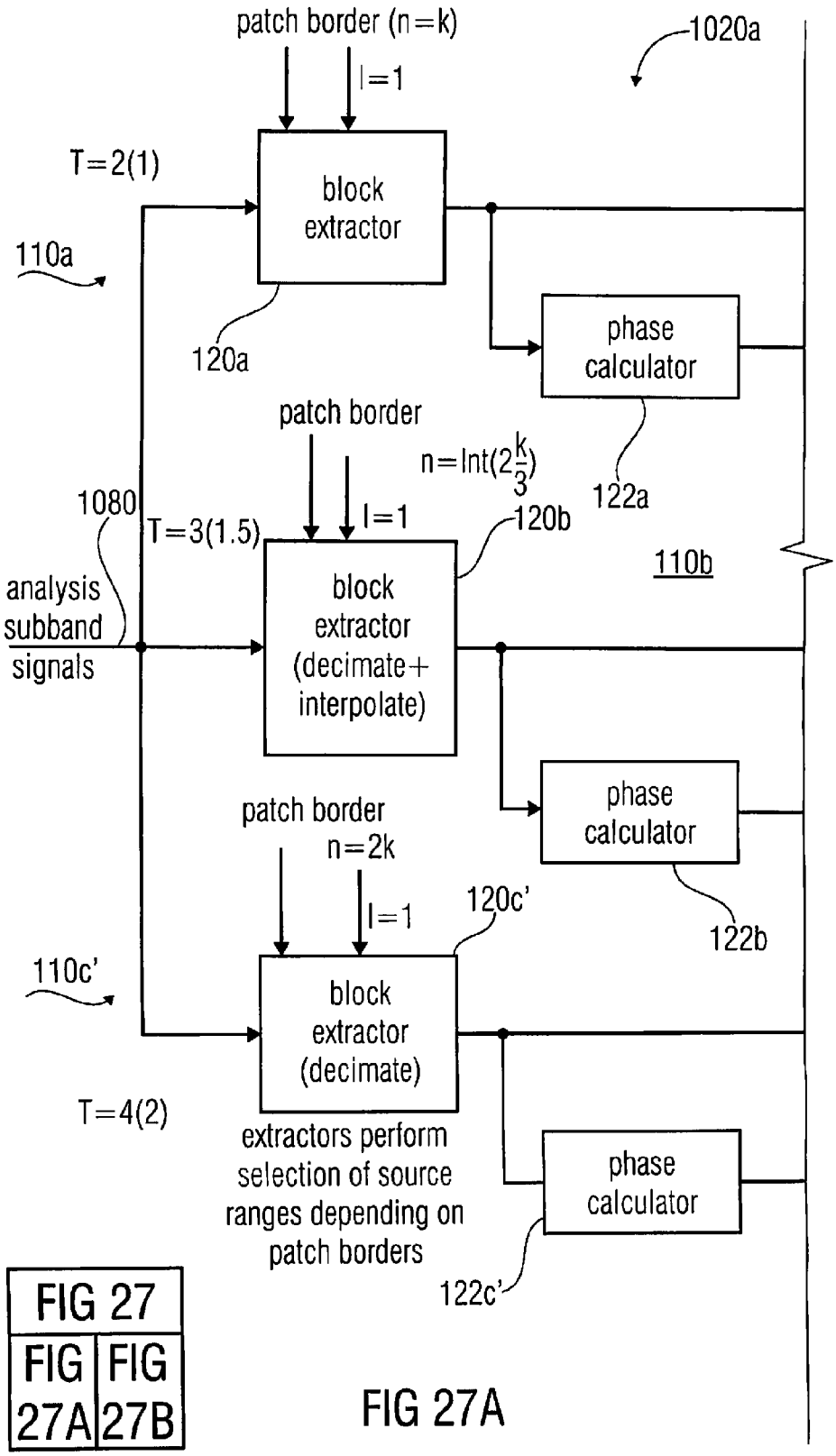
FIG. 27 illustrates an advantageous implementation of a processing of subband signals output by the further analysis filterbank of FIG. 23.
Figure 27B:
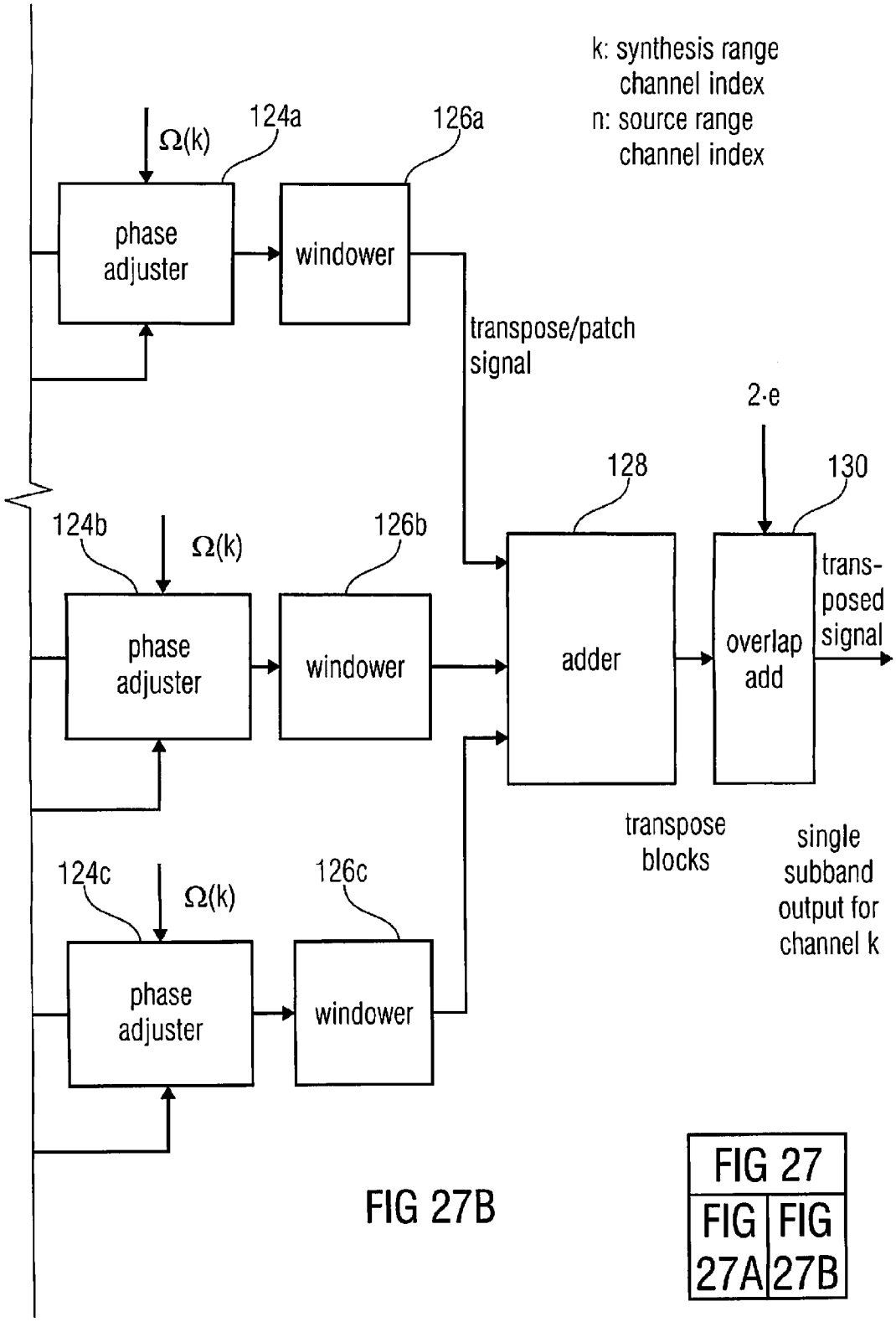

FIG. 27 illustrates a detailed implementation of a embodiment of a non-linear subband processor 1020*a* in FIG. 26. The circuit illustrated in FIG. 27 receives as an input a single subband signal 1080, which is processed in three "branches": The upper branch 110*a* is for a transposition by a transposition factor of 2. The branch in the middle of FIG. 27 indicated at 110*b* is for a transposition by a transposition factor of 3, and the lower branch in FIG. 27 is for a transposition by a transposition factor of 4 and is indicated by reference numeral 110*c*. However, the actual transposition obtained by each processing element in FIG. 27 is only 1 (i.e. no transposition) for branch 110*a*. The actual transposition obtained by the processing element illustrated in FIG. 27 for the medium branch 110*b* is equal to 1.5 and the actual transposition for the lower branch 110*c* is equal to 2. This is indicated by the numbers in brackets to the left of FIG. 27, where transposition factors T are indicated. The transpositions of 1.5 and 2 represent a first transposition contribution obtained by having a decimation operations in branches 110*b*, 110*c* and a time stretching by the overlap-add processor. The second contribution, i.e. the doubling of the transposition, is obtained by the synthesis filterbank 105, which has a synthesis subband spacing 1070 that is two times the analysis filterbank subband spacing. Therefore, since the synthesis filterbank has two times the synthesis subband spacing, any decimations functionality does not take place in branch 110*a*.

Branch 110*b*, however, has a decimation functionality in order to obtain a transposition by 1.5. Due to the fact that the synthesis filterbank has two times the physical subband spacing of the analysis filterbank, a transposition factor of 3 is obtained as indicated in FIG. 27 to the left of the block extractor for the second branch 110*b*.

Analogously, the third branch has a decimation functionality corresponding to a transposition factor of 2, and the final contribution of the different subband spacing in the analysis filterbank and the synthesis filterbank finally corresponds to a transposition factor of 4 of the third branch 110*c*.

Particularly, each branch has a block extractor 120*a*, 120*b*, 120*c* and each of these block extractors can be similar to the block extractor 1800 of FIG. 18. Furthermore, each branch has a phase calculator 122*a*, 122*b* and 122*c*, and the phase calculator can be similar to phase calculator 1804 of FIG. 18. Furthermore, each branch has a phase adjuster 124*a*, 124*b*, 124*c* and the phase adjuster can be similar to the phase adjuster 1806 of FIG. 18. Furthermore, each branch has a windower 126*a*, 126*b*, 126*c*, where each of these windowers can be similar to the windower 1802 of FIG. 18. Nevertheless, the windowers 126*a*, 126*b*, 126*c* can also be configured to apply a rectangular window together with some "zero padding". The transpose or patch signals from each branch 110*a*, 110*b*, 110*c*, in the embodiment of FIG. 11, is input into the adder 128, which adds the contribution from each branch to the current subband signal to finally obtain so-called transpose blocks at the output of adder 128. Then, an overlap-add procedure in the overlap-adder 130 is performed, and the overlap-adder 130 can be similar to the overlap/add block 1808 of FIG. 18. The overlap-adder applies an overlap-add advance value of 2-e, where e is the overlap-advance value or "stride value" of the block extractors 120*a*, 120*b*, 120*c*, and the overlap-adder 130 outputs the transposed signal which is, in the embodiment of FIG. 27, a single subband output for channel k, i.e. for the currently observed subband channel. The processing illustrated in FIG. 27 is performed for each analysis subband or for a certain group of analysis subbands and, as illustrated in FIG. 26, transposed subband signals are input into the synthesis filterbank 105 after being processed by block 103 to finally obtain the transposer output signal illustrated in FIG. 26 at the output of block 105.

In an embodiment, the block extractor 120*a* of the first transposer branch 110*a* extracts 10 subband samples and subsequently a conversion of these 10 QMF samples to polar coordinates is performed. This output, generated by the phase adjuster 124*a*, is then forwarded to the windower 126*a*, which extends the output by zeroes for the first and the last value of the block, where this operation is equivalent to a (synthesis) windowing with a rectangular window of length 10. The block extractor 120*a* in branch 110*a* does not perform a decimation. Therefore, the samples extracted by the block extractor are mapped into an extracted block in the same sample spacing as they were extracted.

However, this is different for branches 110*b* and 110*c*. The block extractor 120*b* advantageously extracts a block of 8 subband samples and distributes these 8 subband samples in the extracted block in a different subband sample spacing. The non-integer subband sample entries for the extracted block are obtained by an interpolation, and the thus obtained QMF samples together with the interpolated samples are converted to polar coordinates and are processed by the phase adjuster. Then, again, windowing in the windower 126*b* is performed in order to extend the block output by the phase adjuster 124*b* by zeroes for the first two samples and the last two samples, which operation is equivalent to a (synthesis) windowing with a rectangular window of length 8.

The block extractor 120*c* is configured for extracting a block with a time extent of 6 subband samples and performs a decimation of a decimation factor 2, performs a conversion of the QMF samples into polar coordinates and again performs an operation in the phase adjuster 124*b*, and the output is again extended by zeroes, however now for the first three subband samples and for the last three subband samples. This operation is equivalent to a (synthesis) windowing with a rectangular window of length 6.

The transposition outputs of each branch are then added to form the combined QMF output by the adder 128, and the combined QMF outputs are finally superimposed using overlap-add in block 130, where the overlap-add advance or stride value is two times the stride value of the block extractors 120*a*, 120*b*, 120*c* as discussed before.

FIG. 27 additionally illustrates the functionality performed by the source band calculator 2507 of FIG. 25*a*, when it is considered that reference number 108 illustrates the available analysis subband signals for a patching, i.e. the signals indicated at 1080 in FIG. 26, which are output by the analysis filterbank 1010 of FIG. 26. A selection of the correct subband from the analysis subband signals or, in the other embodiment relating the to DFT transposer, the application oft the correct analysis frequency window is performed by the block extractors 120*a*, 120*b*, 120*c*. To this end, the patch borders indicating the first subband signal, the last subband signal and the subband signals in between for each patch are provided to the block extractor for each transposition branch. The first branch finally resulting in a transposition factor of T=2 receives, with its block extractor 120*a* all subband indices between xOverQmf(0) and xO-verQmf(1), and the block extractor 120*a* then extracts a block from the thus selected analysis subband. It is to be noted that the patch borders are given as a channel index of the synthesis range indicated by k, and the analysis bands are indicated by n with respect to their subband channels. Hence, since n is calculated by dividing 2k by T, the channel numbers of the analysis band n, therefore, are equal to the channel numbers of the synthesis range due to the double frequency spacing of the synthesis filterbank as discussed in the context of FIG. 26. This is indicated above block 120*a* for the first block extractor 120*a* or, generally, for the first transposer branch 110*a*. Then, for the second patching branch 110*b*, the block extractor receives all the synthesis range channel indices between xOverQmf(1) and xOverQmf(2). Particularly, the source range channel indices, from which the block extractor has to extract the blocks for further processing are calculated from the synthesis range channel indices given by the determined patch borders by multiplying k with the factor of 2/3. Then, the integer part of this calculation is taken as the analysis channel number n, from which the block extractor then extracts the block to be further processed by elements 124*b*, 126*b*.

For the third branch 110*c*, the block extractor 120*c* once again receives the patch borders and performs a block extraction from the subbands corresponding to synthesis bands defined by xOverQmf(2) until xOverQmf(3). The analysis numbers n are calculated by 2 multiplied by k, and this is the calculation rule for calculating the analysis channel numbers from the synthesis channel numbers. In this context, it is to be outlined that xOverQmf corresponds to xOverBin of FIG. 24*a*, although FIG. 24*a* corresponds to the DFT-based patcher, while xOverQmf corresponds to the QMF-based patcher. The calculation rules for determining xOverQmf(i) is determined in the same way as illustrated in FIG. 24*a*, but the factor fftSizeSyn/128 is not required for calculating xOverQmf.

The procedure for determining the patch borders for calculating the analysis ranges for the embodiment of FIG. 27 is also illustrated in FIG. 24*b*. In first step 2600, the patch borders for the patches corresponding to transposition factors 2, 3, 4 and, optionally even more are calculated as discussed in the context of FIG. 24*a* or FIG. 25*a*. Then, the source range frequency domain window for the DFT patcher or the source range subbands for the QMF patcher are calculated by the equations discussed in the context of blocks 120*a*, 120*b*, 120*c*, which are also illustrated to the right of block 2602. Then, a patching is performed by calculating the transposed signal and by mapping the transposed signal to the high frequencies as indicated in block 2604, and the calculating of the transposed signal is particularly illustrated in the procedure of FIG. 27, where the transposed signal output by block overlap add 130 corresponds to the result of the patching generated by the procedure in block 2604 of FIG. 24*b*.

An embodiment comprises a method for decoding an audio signal by using subband block based harmonic transposition, comprising the filtering of a core decoded signal through an M-band analysis filter bank to obtain a set of subband signals; synthesizing a subset of said sub-band signals by means of subsampled synthesis filter banks having a decreased number of subbands, to obtain subsampled source range signals.

An embodiment relates to a method for aligning the spectral band borders of HFR generated signals to spectral borders utilized in a parametric process.

An embodiment relates to a method for aligning the spectral borders of the HFR generated signals to the spectral borders of the envelope adjustment frequency table comprising: the search for the highest border in the envelope adjustment frequency table that does not exceed the fundamental bandwidth limits of the HFR generated signal of transposition factor T; and using the found highest border as the frequency limit of the HFR generated signal of transposition factor T.

An embodiment relates to a method for aligning the spectral borders of the limiter tool to the spectral borders of the HFR generated signals comprising: adding the frequency borders of the HFR generated signals to the table of borders used when creating the frequency band borders used by the limiter tool; and forcing the limiter to use the added frequency borders as constant borders and to adjust the remaining borders accordingly.

An embodiment relates to combined transposition of an audio signal comprising several integer transposition orders in a low resolution filter bank domain where the transposition operation is performed on time blocks of subband signals.

A further embodiment relates to combined transposition, where transposition orders greater than 2 are embedded in an order 2 transposition environment.

A further embodiment relates to combined transposition, where transposition orders greater than 3 are embedded in an order 3 transposition environment, whereas transposition orders lower than 4 are performed separately.

A further embodiment relates to combined transposition, where transposition orders (e.g. transposition orders greater than 2) are created by replication of previously calculated transposition orders (i.e. especially lower orders) including the core coded bandwidth. Every conceivable combination of available transposition orders and core bandwidth is possible without restrictions.

An embodiment relates to reduction of computational complexity due to the reduced number of analysis filter banks which may be used for transposition.

An embodiment relates to an apparatus for generating a bandwidth extended signal from an input audio signal, comprising: a patcher for patching an input audio signal to obtain a first patched signal and a second patched signal, the second patched signal having a different patch frequency compared to the first patched signal, wherein the first patched signal is generated using a first patching algorithm, and the second patched signal is generated using a second patching algorithm; and a combiner for combining the first patched signal and the second patched signal to obtain the bandwidth extended signal.

A further embodiment relates to this apparatus according, in which the first patching algorithm is a harmonic patching algorithm, and the second patching algorithm is a non-harmonic patching algorithm.

A further embodiment relates to a preceding apparatus, in which the first patching frequency is lower than the second patching frequency or vice versa.

A further embodiment relates to a preceding apparatus, in which the input signal comprises a patching information; and in which the patcher is configured for being controlled by the patching information extracted from the input signal to vary the first patching algorithm or the second patching algorithm in accordance with the patching information.

A further embodiment relates to a preceding apparatus, in which the patcher is operative to patch subsequent blocks of audio signal samples, and in which the patcher is configured to apply the first patching algorithm and the second patching algorithm to the same block of audio samples.

A further embodiment relates to a preceding apparatus, in which a patcher comprises, in arbitrary orders, a decimator controlled by a bandwidth extension factor, a filter bank, and a stretcher for a filter bank subband signal.

A further embodiment relates to a preceding apparatus, in which the stretcher comprises a block extractor for extracting a number of overlapping blocks in accordance with an extraction advance value; a phase adjuster or windower for adjusting subband sampling values in each block based on a window function or a phase correction; and an overlap/adder for performing an overlap-add-processing of windowed and phase adjusted blocks using an overlap advance value greater than the extraction advance value.

A further embodiment relates to an apparatus for bandwidth extending an audio signal comprising: a filter bank for filtering the audio signal to obtain downsampled subband signals; a plurality of different subband processors for processing different subband signals in different manners, the subband processors performing different subband signal time stretching operations using different stretching factors; and a merger for merging processed subbands output by the plurality of different subband processors to obtain a bandwidth extended audio signal.

A further embodiment relates to an apparatus for downsampling an audio signal, comprising: a modulator; an interpolator using an interpolation factor; a complex low-pass filter; and a decimator using a decimation factor, wherein the decimation factor is higher than the interpolation factor.

An embodiment relates to an apparatus for downsampling an audio signal, comprising: a first filter bank for generating a plurality of subband signals from the audio signal, wherein a sampling rate of the subband signal is smaller than a sampling rate of the audio signal; at least one synthesis filter bank followed by an analysis filter bank for performing a sample rate conversion, the synthesis filter bank having a number of channels different from a number of channels of the analysis filter bank; a time stretch processor for processing the sample rate converted signal; and a combiner for combining the time stretched signal and a low-band signal or a different time stretched signal.

A further embodiment relates to an apparatus for downsampling an audio signal by a noninteger downsampling factor, comprising: a digital filter; an interpolator having an interpolation factor; a poly-phase element having even and odd taps; and a decimator having a decimation factor being greater than the interpolation factor, the decimation factor and the interpolation factor being selected such that a ratio of the interpolation factor and the decimation factor is non-integer.

An embodiment relates to an apparatus for processing an audio signal, comprising: a core decoder having a synthesis transform size being smaller than a nominal transform size by a factor, so that an output signal is generated by the core decoder having a sampling rate smaller than a nominal sampling rate corresponding to the nominal transform size; and a post processor having one or more filter banks, one or more time stretchers and a merger, wherein a number of filter bank channels of the one or more filter banks is reduced compared to a number as determined by the nominal transform size.

A further embodiment relates to an apparatus for processing a low-band signal, comprising: a patch generator for generating multiple patches using the low-band audio signal; an envelope adjustor for adjusting an envelope of the signal using scale factors given for adjacent scale factor bands having scale factor band borders, wherein the patch generator is configured for performing the multiple patches, so that a border between the adjacent patches coincides with a border between adjacent scale factor bands in the frequency scale.

An embodiment relates to an apparatus for processing a low-band audio signal, comprising: a patch generator for generating multiple patches using the low band audio signal; and an envelope adjustment limiter for limiting envelope adjustment values for a signal by limiting in adjacent limiter bands having limiter band borders, wherein the patch generator is configured for performing the multiple patches so that a border between adjacent patches coincides with a border between adjacent limiter bands in a frequency scale.

The inventive processing is useful for enhancing audio codecs that rely on a bandwidth extension scheme. Especially, if an optimal perceptual quality at a given bitrate is highly important and, at the same time, processing power is a limited resource.

Most prominent applications are audio decoders, which are often implemented on hand-held devices and thus operate on a battery power supply.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a micro-processor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

Literature:

[1] M. Dietz, L. Liljeryd, K. Kjörling and O. Kunz, "Spectral Band Replication, a novel approach in audio coding," in 112th AES Convention, Munich, May 2002.

[2] S. Meltzer, R. Bohm and F. Henn, "SBR enhanced audio codecs for digital broadcasting such as "Digital Radio Mondiale" (DRM)," in 112th AES Convention, Munich, May 2002.

[3] T. Ziegler, A. Ehret, P. Ekstrand and M. Lutzky, "Enhancing mp3 with SBR: Features and Capabilities of the new mp3PRO Algorithm," in 112th AES Convention, Munich, May 2002.

[4] International Standard ISO/IEC 14496-3:2001/FPDAM 1, "Bandwidth Extension," ISO/IEC, 2002. Speech bandwidth extension method and apparatus Vasu Iyengar et al

[5] E. Larsen, R. M. Aarts, and M. Danessis. Efficient high-frequency bandwidth extension of music and speech. In AES 112th Convention, Munich, Germany, May 2002.

[6] R. M. Aarts, E. Larsen, and 0. Ouweltjes. A unified approach to low- and high frequency bandwidth extension. In AES 115th Convention, New York, USA, October 2003.

[7] K. Kiyhko. A Robust Wideband Enhancement for Narrowband Speech Signal. Research Report, Helsinki University of Technology, Laboratory of Acoustics and Audio Signal Processing, 2001.

[8] E. Larsen and R. M. Aarts. Audio Bandwidth Extension—Application to psychoacoustics, Signal Processing and Loudspeaker Design. John Wiley & Sons, Ltd, 2004.

[9] E. Larsen, R. M. Aarts, and M. Danessis. Efficient high-frequency bandwidth extension of music and speech. In AES 112th Convention, Munich, Germany, May 2002.

[10] J. Makhoul. Spectral Analysis of Speech by Linear Prediction. IEEE Transactions on Audio and Electroacoustics, AU-21(3), June 1973.

[11] United States Patent Application 08/951,029, Ohmori , et al. Audio band width extending system and method

[12] U.S. Pat. No. 6895375, Malah, D & Cox, R. V.: System for bandwidth extension of Narrow-band speech

[13] Frederik Nagel, Sascha Disch, "A harmonic bandwidth extension method for audio codecs," ICASSP International Conference on Acoustics, Speech and Signal Processing, IEEE CNF, Taipei, Taiwan, April 2009

[14] Frederik Nagel, Sascha Disch, Nikolaus Rettelbach, "A phase vocoder driven bandwidth extension method with novel transient handling for audio codecs," 126th AES Convention, Munich, Germany, May 2009

[15] M. Puckette. Phase-locked Vocoder. IEEE ASSP Conference on Applications of Signal Processing to Audio and Acoustics, Mohonk 1995.", Röbel, A.: Transient detection and preservation in the phase vocoder; citeseer.ist.psu.edu/679246.html

[16] Laroche L., Dolson M.: "Improved phase vocoder time-scale modification of audio", IEEE Trans. Speech and Audio Processing, vol. 7, no. 3, pp. 323--332,

[17] United States Patent 6549884 Laroche, J. & Dolson, M.: Phase-vocoder pitch-shifting

[18] Herre, J.; Faller, C.; Ertel, C.; Hilpert, J.; Hölzer, A.; Spenger, C, "MP3 Surround: Efficient and Compatible Coding of Multi-Channel Audio," 116th Cony. Aud. Eng. Soc., May 2004

[19] Neuendorf, Max; Gournay, Philippe; Multrus, Markus; Lecomte, Jerémie; Bessette, Bruno; Geiger, Ralf; Bayer, Stefan; Fuchs, Guillaume; Hilpert, Johannes; Rettelbach, Nikolaus; Salami, Redwan; Schuller, Gerald; Lefebvre, Roch; Grill, Bernhard: Unified Speech and Audio Coding Scheme for High Quality at Lowbitrates, ICASSP 2009, April 19-24, 2009, Taipei, Taiwan

[20] Bayer, Stefan; Bessette, Bruno; Fuchs, Guillaume; Geiger, Ralf; Gournay, Philippe; Grill, Bernhard; Hilpert, Johannes; Lecomte, Jerémie; Lefebvre, Roch; Multrus, Markus; Nagel, Frederik; Neuendorf, Max; Rettelbach, Nikolaus; Robilliard, Julien; Salami, Redwan; Schuller, Gerald: A Novel Scheme for Low Bitrate Unified Speech and Audio Coding, 126th AES Convention, May 7, 2009, München

The invention claimed is:

1. An apparatus for processing an audio signal to generate a bandwidth extended signal comprising a high frequency part and a low frequency part using parametric data for the high frequency part, the parametric data relating to frequency bands of the high frequency part, comprising:

a patch border calculator for calculating a patch border of a plurality of patch borders such that the patch border coincides with a frequency band border of the frequency bands of the high frequency part; and a patcher for generating a patched signal using the audio signal and the patch border, wherein the patch borders relate to the high frequency part of the bandwidth extended signal;

wherein the patch border calculator is configured for:

calculating a frequency table defining the frequency bands of the high frequency part using the parametric data or further configuration input data;

setting a target synthesis patch border different from the patch border using at least one transposition factor;

searching, in the frequency table, for a matching frequency band comprising a matching border coinciding with the target synthesis patch border within a predetermined matching range, or searching for the frequency band comprising a frequency band border being closest to the target synthesis patch border; and selecting the matching frequency band as the patch border, wherein the matching frequency band comprises a matching border coinciding with the target synthesis patch border within a predetermined matching range or comprises a frequency band border being closest to the target synthesis patch border.

2. The apparatus in accordance with claim 1, in which the patch border calculator is configured to calculate patch borders for three different transposition factors such that each patch border coincides with a frequency band border of the frequency bands of the high frequency part, and in which the patcher is configured to generate the patched signal using the three different transposition factors so that a border between adjacent patches coincides with a border between two adjacent frequency bands.

3. The apparatus in accordance with claim 1, in which the patch border calculator is configured to calculate the patch border as a frequency border in a synthesis frequency range corresponding to the high frequency part, and wherein the patcher is configured to select a frequency portion of the low band part using a transposition factor and the patch border.

4. The apparatus in accordance with claim 1, further comprising:

a high frequency reconstructor for adjusting the patched signal using the parametric data, the high frequency reconstructor being configured for calculating, for a frequency band or a group of frequency bands, a gain factor to be used for weighting the corresponding frequency band or groups of frequency bands of the patched signal.

5. The apparatus in accordance with claim 1, in which the predetermined matching range is set to a value smaller than or equal to five QMF bands or 40 frequency bins of the high frequency part.

6. The apparatus in accordance with claim 1, in which the parametric data comprise a spectral envelope data value, wherein, for each frequency band, a separate spectral envelope data value is given, wherein the apparatus further comprises a high frequency reconstructor for spectral envelope adjusting each band of the patched signal using the spectral envelope data value for this band.

7. The apparatus in accordance with claim 1, in which the patch border calculator is configured for searching for the highest border in the frequency table that does not exceed a bandwidth limit of a high frequency regenerated signal for a transposition factor, and to use the found highest border as the patch border.

8. The apparatus in accordance with claim 7, in which the patch border calculator is configured to receive, for each transposition factor of the plurality of different transposition factors, a different target patch border.

9. The apparatus in accordance with claim 1, further comprising a limiter tool for calculating limiter bands used in limiting gain values for adjusting the patched signals, the apparatus further comprising a limiter band calculator configured to set a limiter border so that at least a patch border determined by the patch border calculator is set as a limiter border as well.

10. The apparatus in accordance with claim 9, in which the limiter band calculator is configured to calculate further limiter borders so that the further limiter borders coincide with frequency band borders of the frequency bands of the high frequency part.

11. The apparatus in accordance with claim 1, in which the patcher is configured for generating multiple patches using different transposition factors, in which the patch border calculator is configured to calculate the patch borders of each patch of the multiple patches so that the patch borders coincide with different frequency band borders of the frequency bands of the high frequency part, wherein the apparatus further comprises an envelope adjuster for adjusting an envelope of the high frequency part after patching or for adjusting the high frequency part before patching using scale factors comprised by the parametric data given for scale factor bands.

12. A method of processing an audio signal to generate a bandwidth extended signal comprising a high frequency part and a low frequency part using parametric data for the high frequency part, the parametric data relating to frequency bands of the high frequency part, comprising:

calculating a patch border such that the patch border of a plurality of patch borders coincides with a frequency band border of the frequency bands of the high frequency part; and generating a patched signal using the audio signal and the patch border, wherein the patch borders relate to the high frequency part of the bandwidth extended signal, wherein said calculating a patch border comprises:

calculating a frequency table defining the frequency bands of the high frequency part using the parametric data or further configuration input data;

setting a target synthesis patch border different from the patch border using at least one transposition factor;

searching, in the frequency table, for a matching frequency band comprising a matching border coinciding with the target synthesis patch border within a predetermined matching range, or to search for the frequency band comprising a frequency band border being closest to the target synthesis patch border; and selecting the matching frequency band as the patch border, wherein the matching frequency band comprises a matching border coinciding with the target synthesis patch border within a predetermined matching range or comprises a frequency band border being closest to the target synthesis patch border.

13. A non-transitory storage medium having stored thereon a computer program comprising a program code for performing when running on a computer, the method of processing an audio signal to generate a bandwidth extended signal comprising a high frequency part and a low frequency part using parametric data for the high frequency part, the parametric data relating to frequency bands of the high frequency part, said method comprising:

calculating a patch border such that the patch border of a plurality of patch borders coincides with a frequency band border of the frequency bands of the high frequency part; and generating a patched signal using the audio signal and the patch border, wherein the patch borders relate to the high frequency part of the bandwidth extended signal, wherein said calculating a patch border comprises:

calculating a frequency table defining the frequency bands of the high frequency part using the parametric data or further configuration input data;

setting a target synthesis patch border different from the patch border using at least one transposition factor;

searching, in the frequency table, for a matching frequency band comprising a matching border coinciding with the target synthesis patch border within a predetermined matching range, or to search for the frequency band comprising a frequency band border being closest to the target synthesis patch border; and selecting the matching frequency band as the patch border, wherein the matching frequency band comprises a matching border coinciding with the target synthesis patch border within a predetermined matching range or comprises a frequency band border being closest to the target synthesis patch border.

* * * * *